US009592586B2

(12) United States Patent
Lehnig et al.

(10) Patent No.: US 9,592,586 B2
(45) Date of Patent: Mar. 14, 2017

(54) APPARATUS AND METHOD FOR HIGH FLOW PARTICLE BLASTING WITHOUT PARTICLE STORAGE

(71) Applicant: COLD JET LLC, Loveland, OH (US)

(72) Inventors: Tony R. Lehnig, West Chester, OH (US); Scott T. Hardoerfer, Milford, OH (US); Richard J. Broecker, Milford, OH (US); William I. Bischoff, West Harrison, IN (US)

(73) Assignee: Cold Jet LLC, Loveland, OH (US)

( * ) Notice: Subject to any disclaimer, the term of this patent is extended or adjusted under 35 U.S.C. 154(b) by 204 days.

(21) Appl. No.: 13/757,133

(22) Filed: Feb. 1, 2013

(65) Prior Publication Data

US 2013/0203325 A1 Aug. 8, 2013

Related U.S. Application Data

(60) Provisional application No. 61/608,639, filed on Mar. 8, 2012, provisional application No. 61/594,347, filed on Feb. 2, 2012.

(51) Int. Cl.

| | |
|---|---|
| ***B24C 5/06*** | (2006.01) |
| ***B24C 1/00*** | (2006.01) |
| ***B24C 9/00*** | (2006.01) |

(52) U.S. Cl.

CPC ..... *B24C 1/003* (2013.01); *B24C 5/06* (2013.01); *B24C 9/00* (2013.01)

(58) Field of Classification Search

CPC ... F25C 5/12; B24C 1/003; B24C 9/00; B24C 5/06

See application file for complete search history.

(56) References Cited

U.S. PATENT DOCUMENTS

| | | | | |
|---|---|---|---|---|
| 525,195 | A * | 8/1894 | Egner | F25C 5/12 241/92 |
| 1,218,079 | A * | 3/1917 | Gouinlock | F25C 5/12 241/92 |
| 4,744,181 | A | 5/1988 | Moore et al. | |
| 4,843,770 | A | 7/1989 | Crane et al. | |
| 4,947,592 | A | 8/1990 | Lloyd et al. | |
| 5,018,667 | A | 5/1991 | Lloyd | |
| 5,050,805 | A | 9/1991 | Lloyd et al. | |
| 5,071,289 | A | 12/1991 | Spivak | |
| 5,109,636 | A | 5/1992 | Lloyd et al. | |

(Continued)

FOREIGN PATENT DOCUMENTS

| | | |
|---|---|---|
| CN | 202028582 U | 11/2011 |
| DE | 202011001264 U1 | 5/2011 |
| WO | WO 2008/144405 | 11/2008 |

OTHER PUBLICATIONS

International Search Report and Written Opinion dated May 28, 2013 for Application No. PCT/US2013/024425.

(Continued)

*Primary Examiner* — Cassey D Bauer
(74) *Attorney, Agent, or Firm* — Frost Brown Todd LLC

(57) ABSTRACT

A particle blast apparatus transport is capable of generating granular sized particles and delivering them without substantial storage to a single hose feeder assembly. The apparatus is configured to be used with solid blocks of cryogenic material, such as carbon dioxide, and with individual pellets of such material.

7 Claims, 41 Drawing Sheets

(56) References Cited

U.S. PATENT DOCUMENTS

| | | | |
|---|---|---|---|
| 5,188,151 | A | 2/1993 | Young et al. |
| 5,203,794 | A | 4/1993 | Stratford et al. |
| 5,249,426 | A | 10/1993 | Spivak et al. |
| 5,288,028 | A | 2/1994 | Spivak et al. |
| 5,301,509 | A | 4/1994 | Lloyd et al. |
| 5,473,903 | A | 12/1995 | Lloyd et al. |
| 5,520,572 | A | 5/1996 | Opel et al. |
| 5,571,335 | A | 11/1996 | Lloyd |
| 5,660,580 | A | 8/1997 | Lehnig |
| 5,795,214 | A | 8/1998 | Leon |
| 6,024,304 | A | 2/2000 | Sawada |
| 6,042,458 | A | 3/2000 | Lehnig et al. |
| 6,346,035 | B1 | 2/2002 | Anderson et al. |
| 6,447,377 | B1 | 9/2002 | Londenberg et al. |
| 6,695,679 | B2 | 2/2004 | Anderson et al. |
| 6,695,685 | B2 | 2/2004 | Stratford et al. |
| 6,726,549 | B2 | 4/2004 | Rivir et al. |
| 6,824,450 | B2 | 11/2004 | Opel |
| 8,187,057 | B2 | 5/2012 | Broecker |
| 8,277,288 | B2 | 10/2012 | Spivak et al. |
| 2003/0064665 | A1 | 4/2003 | Opel |
| 2006/0205326 | A1 | 9/2006 | Dressman |
| 2007/0128988 | A1 | 6/2007 | Rivir et al. |
| 2008/0296797 | A1 | 12/2008 | Broecker et al. |
| 2009/0093196 | A1 | 4/2009 | Dressman et al. |
| 2012/0291479 | A1 | 11/2012 | Moore et al. |

OTHER PUBLICATIONS

U.S. Appl. No. 61/394,688, filed Oct. 19, 2010.
U.S. Appl. No. 61/487,837, filed May 19, 2011.
U.S. Appl. No. 61/608,639, filed Mar. 8, 2012.
U.S. Appl. No. 61/594,347, filed Feb. 2, 2102.
Chinese Office Action dated Jan. 26, 2016 for Application No. 201380018077.5, 13pgs.

* cited by examiner

APPARATUS AND METHOD FOR HIGH FLOW PARTICLE BLASTING WITHOUT PARTICLE STORAGE

CROSS REFERENCE TO RELATED APPLICATIONS

This application claims priority to U.S. Patent App. No. 61/608,639, filed Mar. 8, 2012 and U.S. patent App. No. 61/594,347, filed Feb. 2, 2012, the disclosures of which are hereby incorporated by reference in their entirety.

TECHNICAL FIELD

The present invention relates generally to particle blasting using cryogenic material, and is particularly directed to a method and device involving blasting with carbon dioxide blast media, such as pellets or particles, which are delivered entrained in a high flow of transport gas with substantially no storage of the carbon dioxide media.

BACKGROUND OF THE INVENTION

Carbon dioxide blasting systems are well known, and along with various associated component parts, are shown in U.S. Pat. Nos. 4,744,181, 4,843,770, 4,947,592, 5,018,667, 5,050,805, 5,071,289, 5,109,636, 5,188,151, 5,203,794, 5,249,426, 5,288,028, 5,301,509, 5,473,903, 5,520,572, 5,571,335, 5,660,580, 5,795,214, 6,024,304, 6,042,458, 6,346,035, 6,447,377, 6,695,679, 6,695,685, and 6,824,450, all of which are incorporated herein by reference. Additionally, U.S. patent application Ser. No. 11/344,583, filed Jan. 31, 2006, for PARTICLE BLAST CLEANING APPARATUS WITH PRESSURIZED CONTAINER, U.S. patent application Ser. No. 11/853,194, filed Sep. 11, 2007, for PARTICLE BLAST SYSTEM WITH SYNCHRONIZED FEEDER AND PARTICLE GENERATOR, U.S. patent application Ser. No. 12/121,356, filed May 15, 2008, for PARTICLE BLASTING METHOD AND APPARATUS THEREFOR, U.S. patent application Ser. No. 12/348,645, filed Jan. 5, 2009, for BLAST NOZZLE WITH BLAST MEDIA FRAGMENTER, U.S. Patent Provisional Application Ser. No. 61/394,688 filed Oct. 19, 2010, for METHOD AND APPARATUS FOR FORMING CARBON DIOXIDE PARTICLES INTO BLOCKS, and U.S. Patent Provisional Application Ser. No. 61/487,837 filed May 19, 2011, for METHOD AND APPARATUS FOR FORMING CARBON DIOXIDE PARTICLES, are hereby incorporated by reference.

In a particle blast system, typically, particles, also known as blast media, are ejected by a particle acceleration device, generally referred to as a blast nozzle, and directed toward a workpiece or other target (also referred to herein as an article). Particles may be introduced into a transport gas flow through a feeder, such as is disclosed in U.S. Pat. No. 6,726,549, which is incorporated herein by reference, and transported by the transport gas, entrained therein, from the feeder to the blast nozzle through a single hose (known as a one hose system). It is also known to introduce particles into the high pressure gas at the blast nozzle, the blast nozzle being configured to combine the particle flow arriving entrained in a low volume gas flow through a first hose with high pressure gas arriving in a second hose and eject the entrained flow therefrom (known as a two hose system).

Various sizes are known for carbon dioxide blast media, such as pellets and granules, the selection of which is made in dependence on the blasting needs. Pellets may be formed by extruding carbon dioxide snow through a die plate. Pellet diameters come in various sizes, for example ranging from 3 mm to 12 mm. Granules may be formed by any suitable process, such as by use of the apparatus for generating carbon dioxide granules from a block, referred to as a shaver, as is disclosed in U.S. Pat. No. 5,520,572, which is incorporated herein by reference, in which a working edge, such as a knife edge, is urged against and moved across a block of carbon dioxide. As shown in the '572 patent, the granules so generated are fed directly into the low volume gas flow, such as by Venturi induction as shown in FIG. 1 of the '572 patent, transported by the first hose to the blast nozzle 102 ('572, FIG. 6) where it is combined with the high pressure gas and directed toward a workpiece.

Unwanted sublimation of the carbon dioxide blast media occurs prior to the media reaching the workpiece whenever the environmental conditions allow. Sublimation of granules can be a significant problem, due at least in part to the very small mass of each individual granule relative to its volume and surface area. For example, the '572 patent teaches to deliver the granules, generated by shaving a dry ice block, directly into the first hose of the two hose system with substantially no storage of the granules to be transported to be combined with the high pressure gas.

Until the present invention, due to sublimation, systems utilizing granules were limited to low flow apparatuses. Double hose and single hose granule systems were known, but high flow systems were not. Two hose systems using granular blast media were typically limited to low flow, with a maximum hose (for transporting granules) internal diameter of ¾" and maximum length of 50 feet. Previously, persons of greater than ordinary skill in the art designed such systems to avoid high volume gas flow based on the conclusion that the sublimation rate of granules was proportional to the volume of the flow of gas in which the granules were entrained, leading to prior art systems maintaining low flow through small hose diameters for hoses. Attempts at using large diameter hoses in single hose systems resulted in systems with sublimation rates that required granular media flow rates of 10 to 20 lbs per minute just to equal the results of the two hose systems delivering 5 lbs per minute. Such result reinforced the continued use of smaller hose diameters.

The present inventors have overcome the problems unsolved by such persons of more than ordinary skill in the art, and successfully configured a single hose granular blast media system capable of delivering high flow, based on their determination that the sublimation problem was not the result of the volume of the gas flow that entrained the granules, but rather was the result of the velocity of the gas flow in which the particles were entrained. The inventors have determined that it is the difference between the speed of the gas flow and the speed of the granules that results in sublimation: The greater the difference the greater the sublimation. Applying the inventors' discovery to the prior art attempts at single hose granular blast media systems, it is now to be understood that the increase in sublimation that accompanied use of a larger cross sectional area hose (i.e., the larger diameter hose), which was misinterpreted by those of more than ordinary skill in the art as resulting from increased flow volume, was the result of increased gas velocity resulting from use of nozzles which that increased the gas speed in the hose (instead of decreasing gas speed which, with increased cross sectional area, would be expected to decrease speed). However, the inventors' present invention overcomes the misunderstandings, misinterpretations and shortcomings of the prior art by providing a single hose granular blast media system with high flow configured to maintain the speed differential between the transport gas and the entrained granules low enough to keep sublimation rates low enough to be functionally acceptable.

Although the present invention will be described herein in connection with a particle feeder for use with carbon dioxide blasting, it will be understood that the present invention is not limited in use or application to carbon dioxide blasting. The teachings of the present invention may be used in applications using particles of any sublimeable and/or cryogenic material.

BRIEF DESCRIPTION OF THE DRAWINGS

The accompanying drawings, which are incorporated in and constitute a part of this specification, illustrate embodiments of the invention, and, together with the general description of the invention given above, and the detailed description of the embodiments given below, serve to explain the principles of the present invention.

Figure 1:
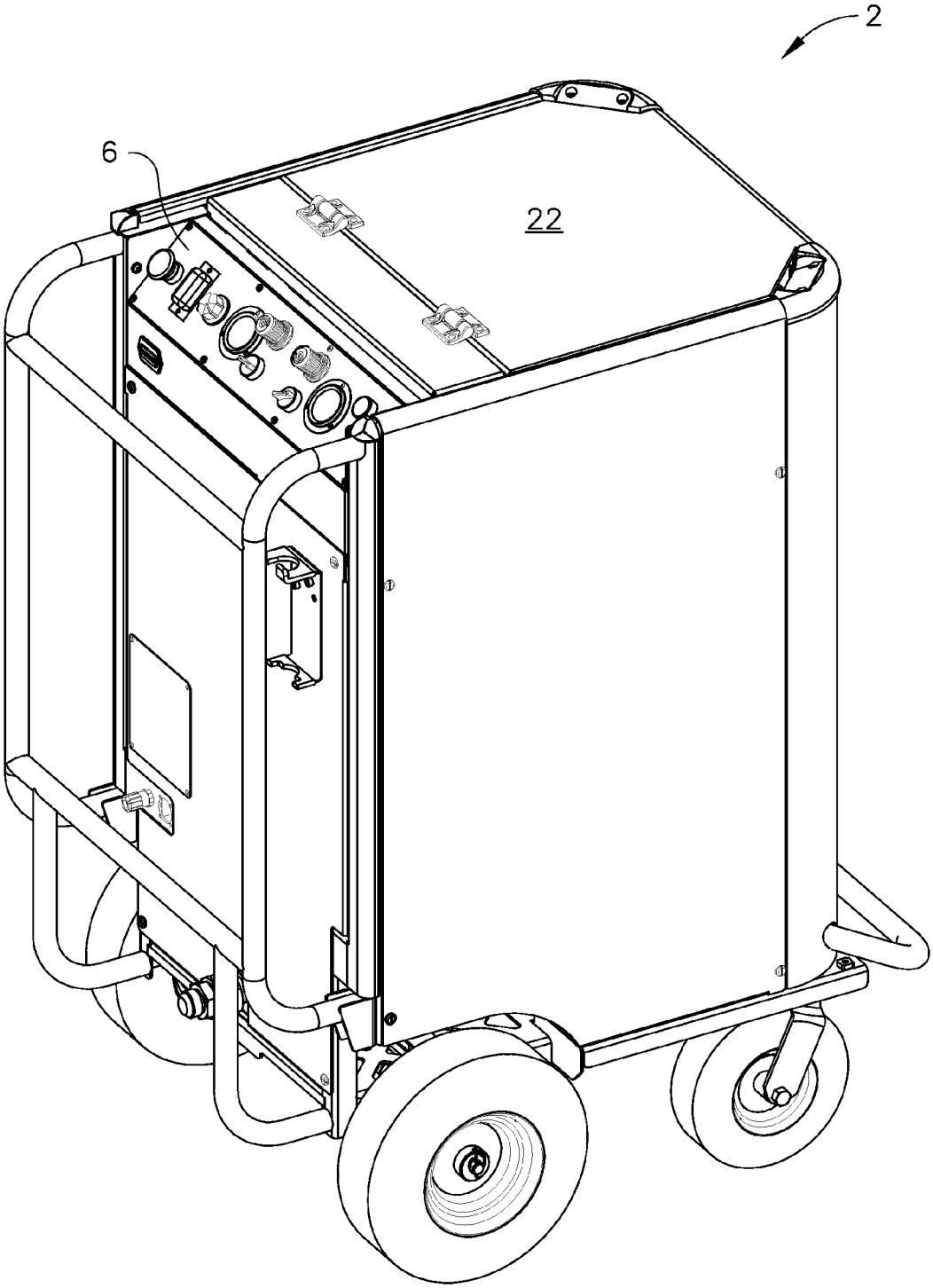
FIG. 1 is a perspective view of a particle blast apparatus constructed in accordance with teachings of the present invention.

Reference will now be made in detail to an embodiment of the invention, an example of which is illustrated in the accompanying drawings.

DESCRIPTION

In the following description, like reference characters designate like or corresponding parts throughout the several views. Also, in the following description, it is to be understood that terms such as front, back, inside, outside, and the like are words of convenience and are not to be construed as limiting terms. Terminology used in this patent is not meant to be limiting insofar as devices described herein, or portions thereof, may be attached or utilized in other orientations. Referring in more detail to the drawings, an embodiment of the invention will now be described.

Double Motor Embodiment

Figure 2:
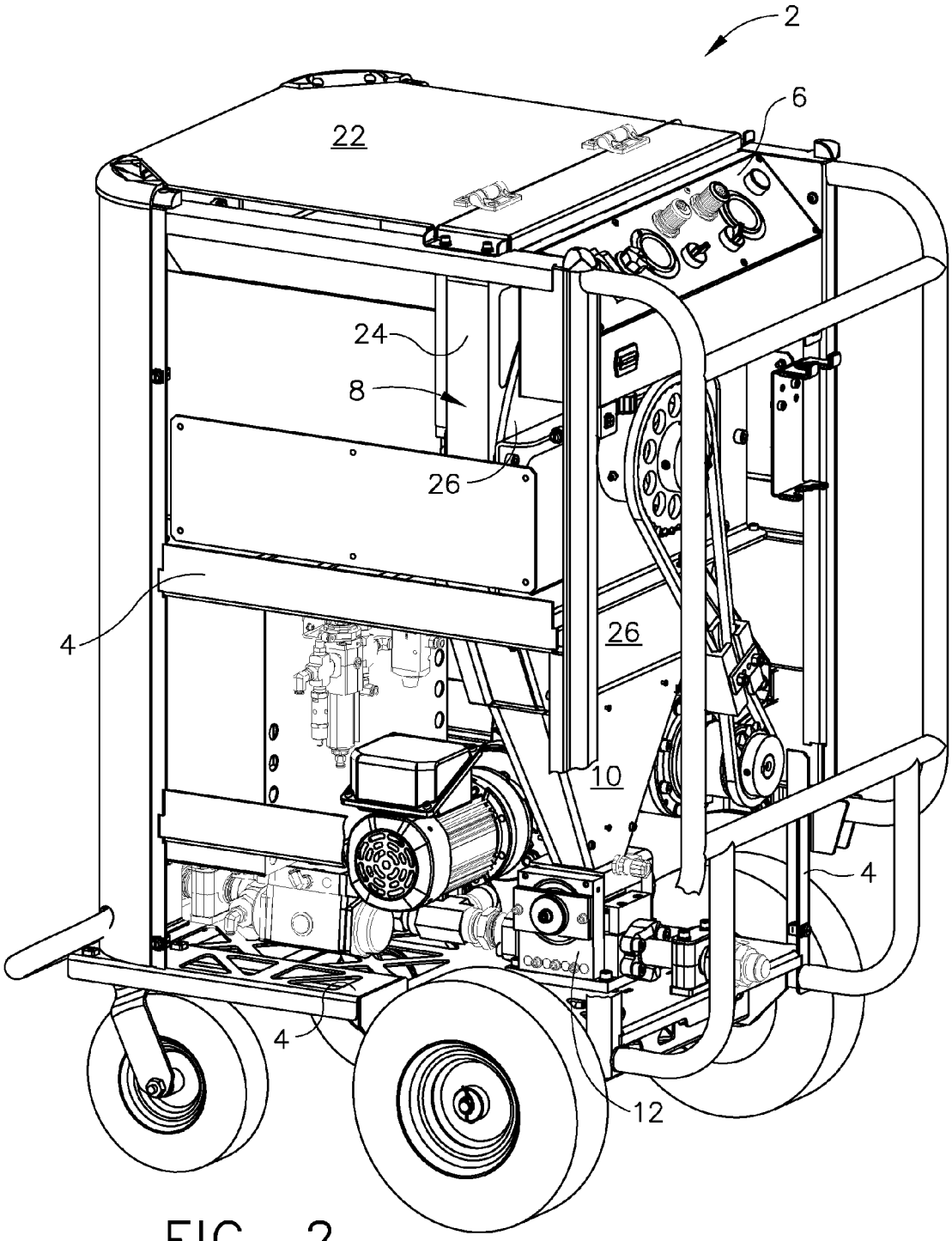
FIG. 2 is perspective view of the particle blast apparatus of FIG. 1, with the covers omitted.

FIGS. 1 and 2 show perspective views of a particle blast apparatus constructed in accordance with teachings of the present invention. Particle blast apparatus, generally indicated at 2, includes frame 4 which carries and supports the individual components of the blaster, as will be described below. Control panel 6 is located at the front of particle blast apparatus 2 to control the device through a series of valves, switches, and timers. The valves, switches, timers, and controls that can be pneumatic, electric, or any combination thereof.

Figure 3:
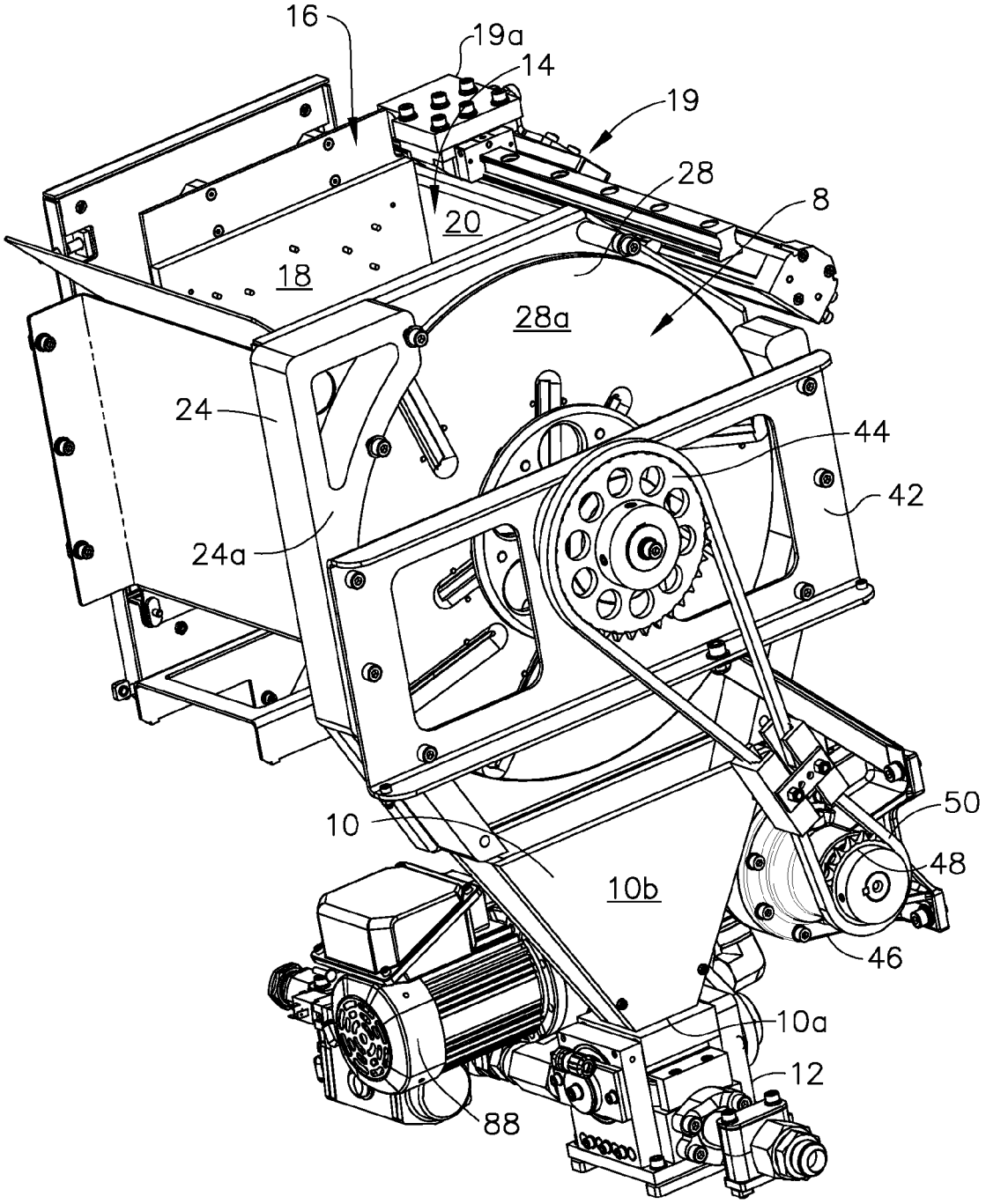
FIG. 3 is a perspective view from the upper left front illustrating the particle generator and feeder assembly of the particle blast apparatus of FIG. 1.
Figure 5:
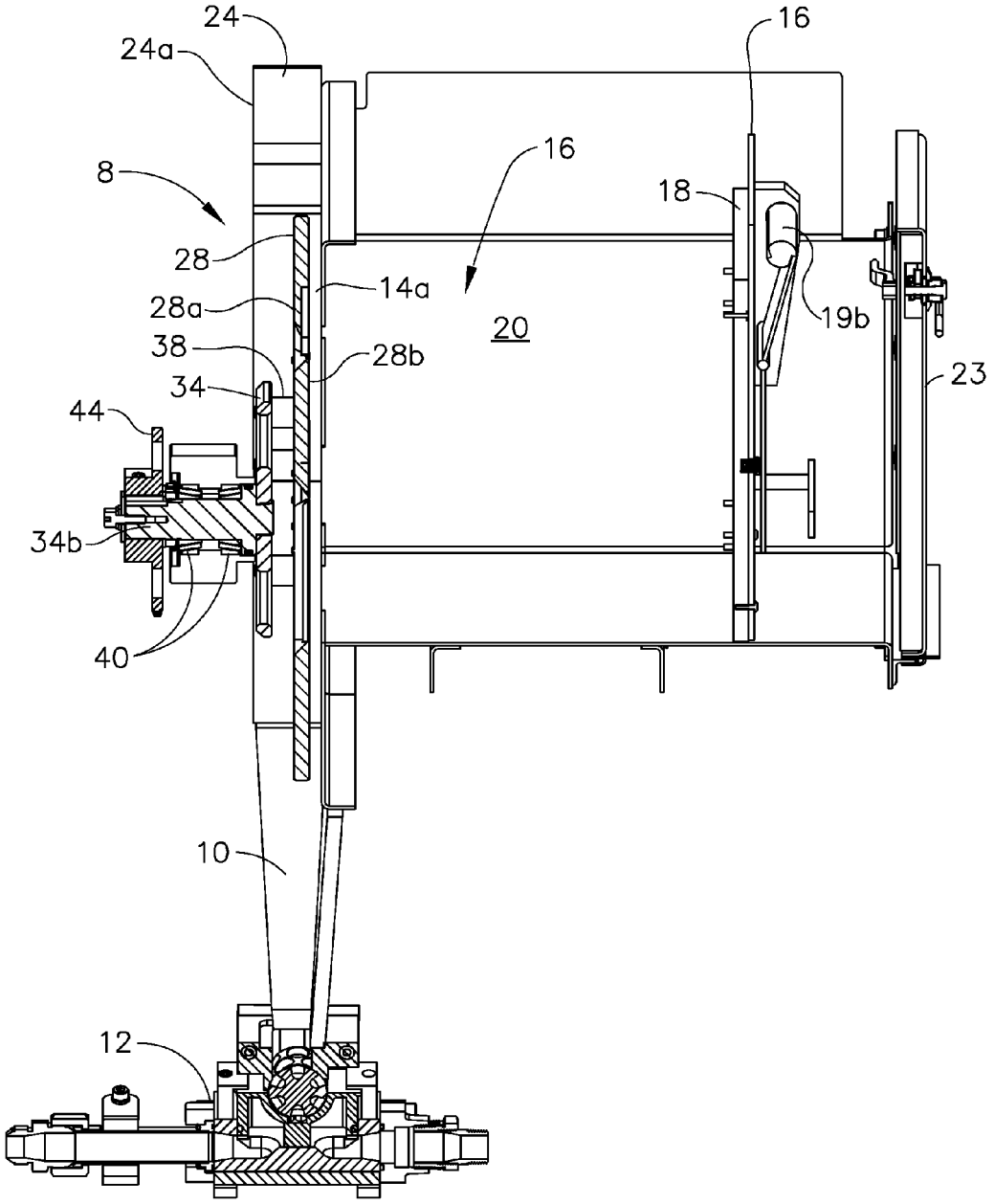
FIG. 5 is a side cross-sectional view taken along the midline of the particle generator and feeder assembly of the particle blast apparatus of FIG. 1.
Figure 6:
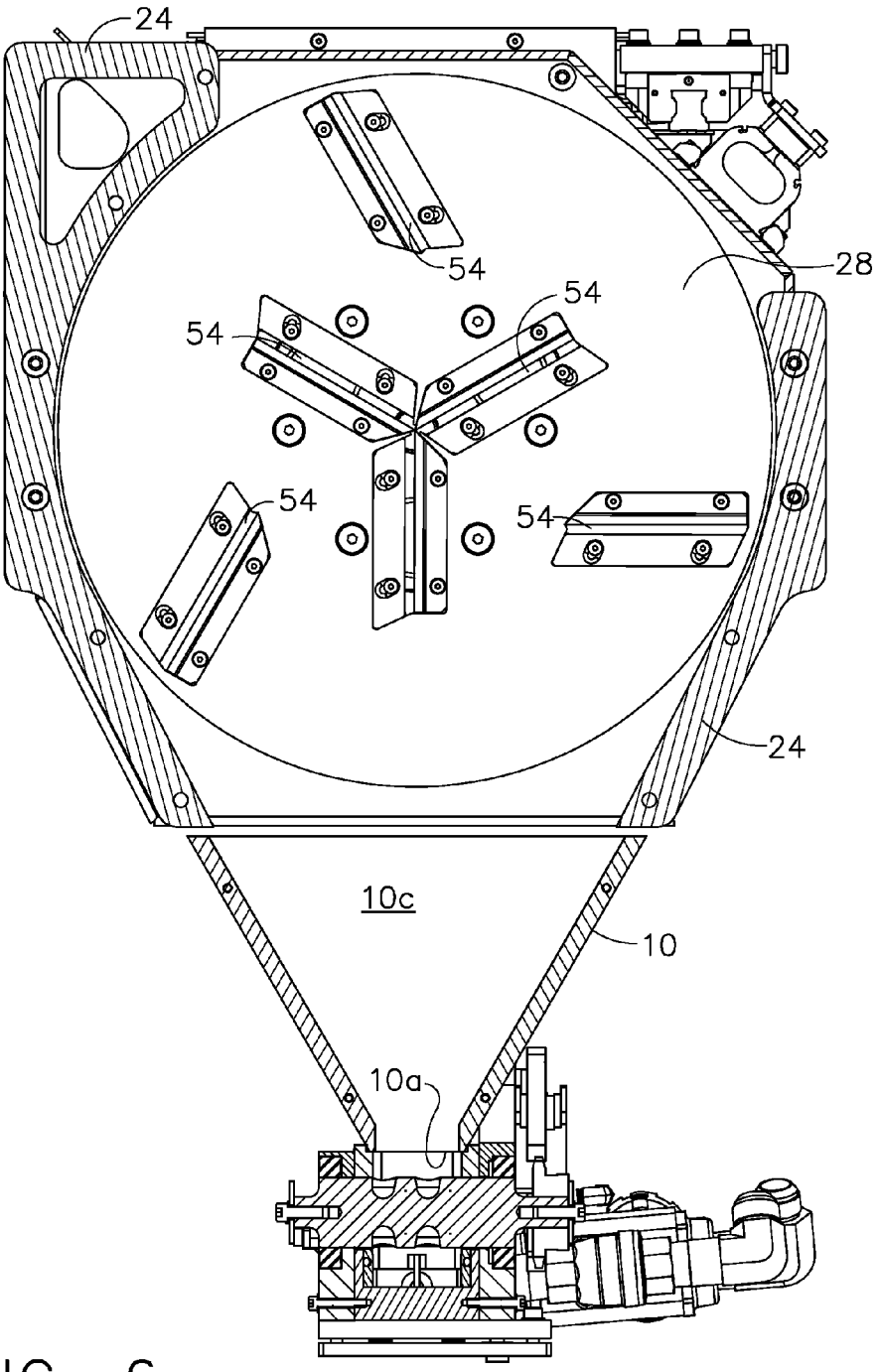
FIG. 6 is front cross-sectional view taken along the midline of the particle generator and feeder assembly of the particle blast apparatus of FIG. 1.

Referring to FIG. 3, there is shown a perspective view of particle generator, generally indicated at 8, duct 10 and feeder assembly 12. Particle generator 8 is disposed adjacent storage bin 14. Bin 14 is configured to receive a block of solid carbon dioxide, such as a standard size commercially available block of dry ice, e.g., 10"×10"×12", or to receive preformed pellets. Pressure plate 16 is longitudinally movable within bin 14, toward and away from particle generator 8. Pressure plate 16 may, as depicted in FIG. 3, include lining 18 made of a material suitable for contacting the solid material disposed in bin 14, such as UHMW plastic. Pressure plate 16 is configured to urge any material, whether a block or a plurality of individual pellets, disposed within bin 14, toward particle generator 8 so as to cause such material to remain in contact with particle generator 8 with sufficient force for particle generator to generate particles for introduction into the transport gas flow. Pressure plate 16 may be resiliently biased toward particle generator 8 and/or may be connected to actuator 19 to move pressure plate 16 toward and away from particle generator 8. In the embodiment depicted, actuator 19 is a linear actuator and includes carriage 19*a* which is connected to pressure plate 16 by arm 19*b* (see FIG. 5) extending from carriage. Spaced apart sides 20 of bin 14 are made of any suitable material, preferably which resists the material disposed within bin 14 from sticking to sides 20. Hinged lid 22 overlies bin 14 to facilitate filling bin 14 with material, such as dry ice. Additionally, apparatus 2 includes rear door 23 which may be opened by pivoting about a hinge, horizontal in the embodiment depicted. Pressure plate 16 may be moved out of the way to allow solid material, such a block, to be loaded into storage bin 14 from the rear.

Referring also to FIGS. 5-8, particle generator 8 includes housing 24 to which cover 26 is attached to out facing surface 24*a* of housing 24. Particle generator 8 includes rotatable carrier 28 which carries one or more working edges 30 and respective slides 32. Carrier 28 moves relative to bin 14 with the material disposed in bin 14 being urged against inner surface 28*b* of carrier 28. Carrier 28 is connected to rotor 34 by a plurality of fasteners 36, with a plurality of spacers 38 which establish space between surface 28*a* of carrier 28 and rotor 34 through which the generated particles may fall. In the embodiment depicted, rotor 34 has a plurality of holes 34*a* in order to reduce the weight of rotor 34. Rotor 34 also includes hub 34*b* which carries the inner races of bearings 40 that rotatably support rotor 34. The outer races of bearings 40 are supported by frame 42, which is in turn supported by housing 24. Thus, through bearings 40 and hub 34*b*, rotor 34 is rotably supported by frame 42.

Hub 34*b* also carries driven element 44, which is non-rotatably fixed to hub 34*b*. Motor 46 is carried by apparatus 2, with drive element 48 secured to the output of motor 46. Belt 50 engages drive element 48 and driven element 44 to provide the rotation of hub 34 and thereby rotate carrier 28.

Housing 24 is secured to bin 14, with inner surface 24*b* abutting bin 14. With cover 26 in place (not illustrated in FIG. 5), collector chamber 52 is defined such that particles passing through openings 54 of rotatable carrier 28 flow into and through collector chamber 52. Particles generated above hub 34 can fall though the space between hub 34 and carrier 28 created by spacers 38. Particles fall through collector chamber 52 into duct 10 passing therethrough and out duct exit 10*a* directly to feeder assembly 12. With cover 10*b* in place, duct 10 defines internal passageway 10*c* that places collector chamber 52 in fluid communication with feeder assembly feeder 12.

Figure 7:
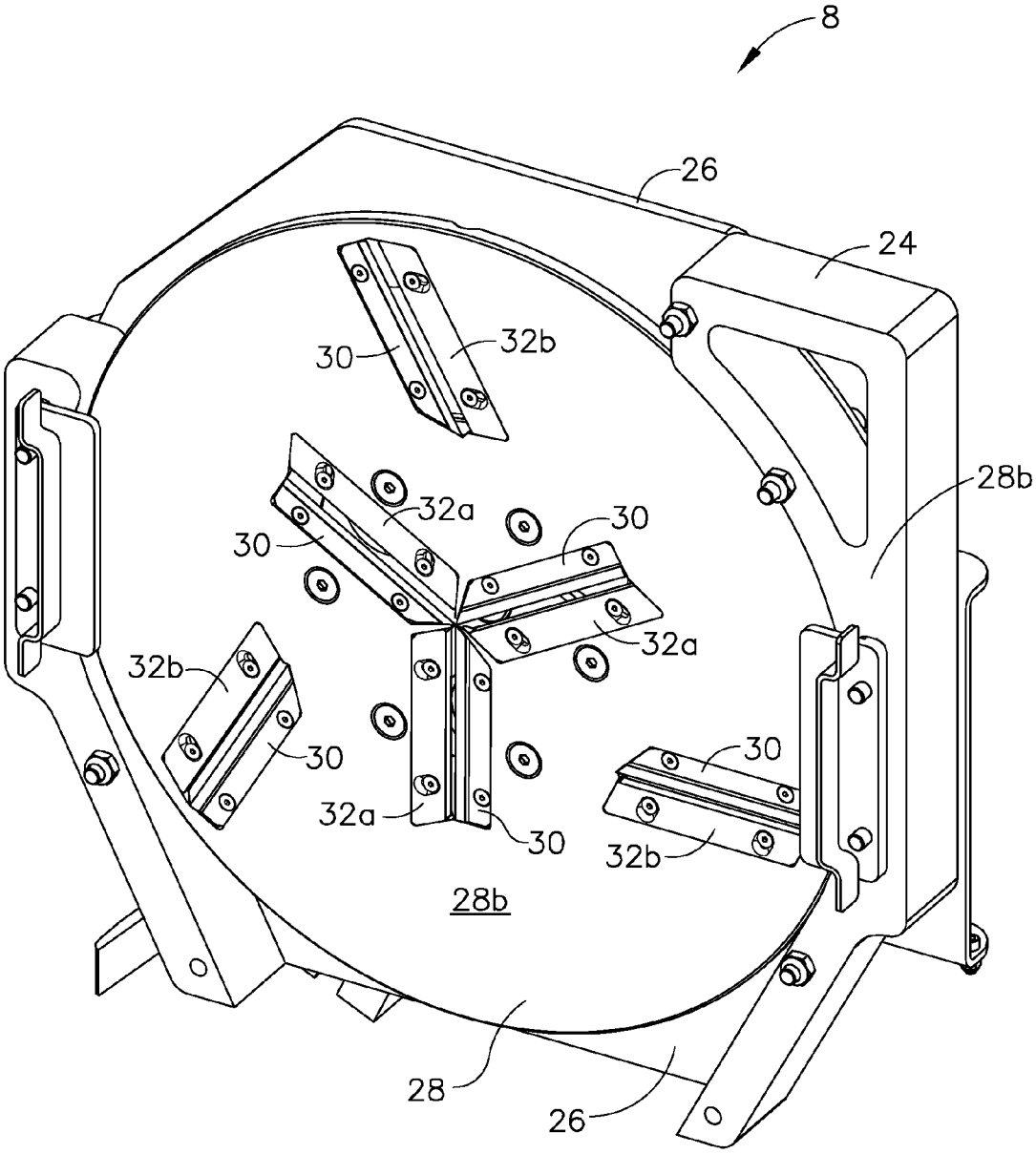
FIG. 7 is a perspective view of the rotatable carrier and housing of the particle generator of the particle blast apparatus of FIG. 1.
Figure 8:
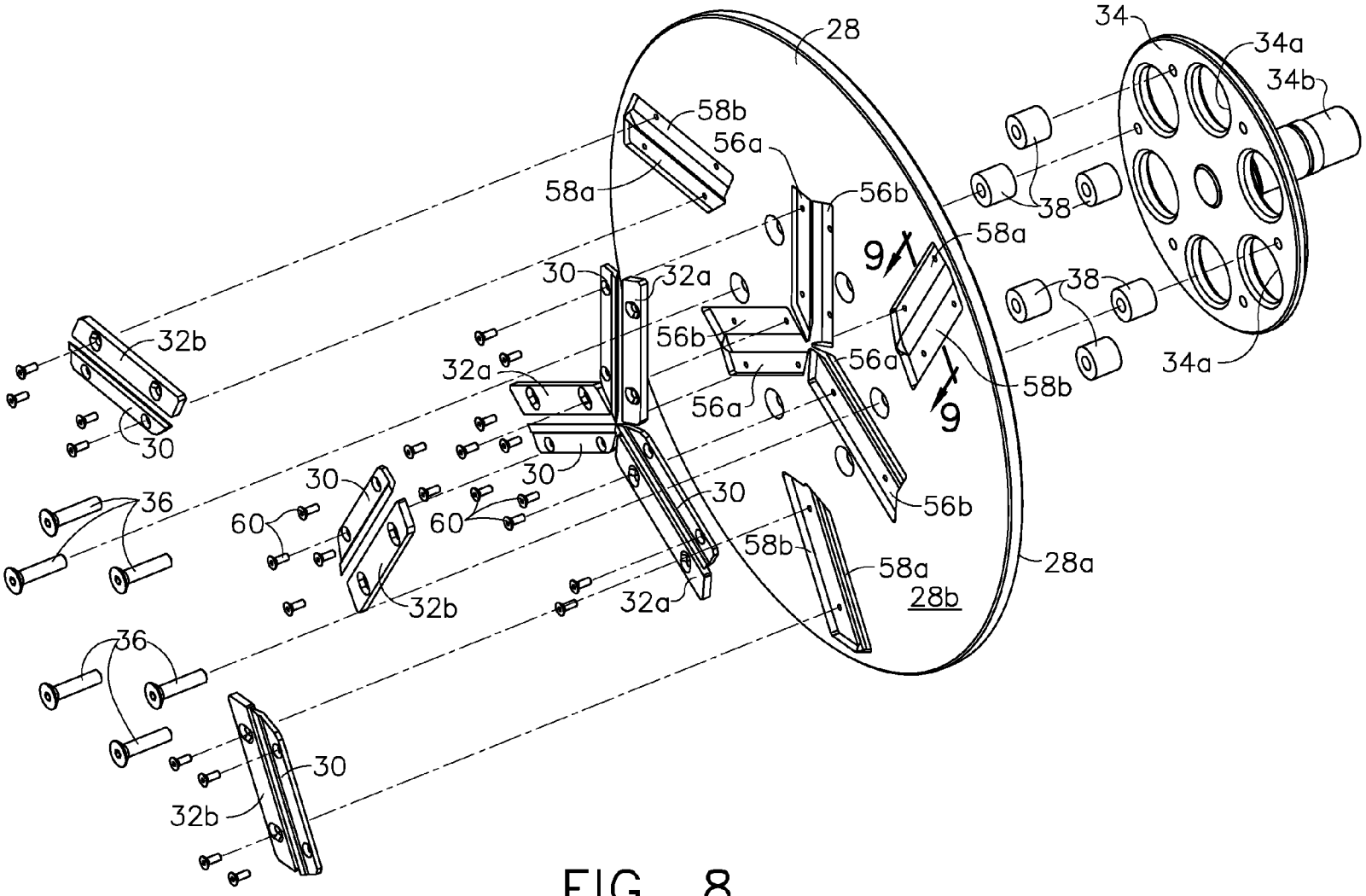
FIG. 8 is an exploded view of the rotatable carrier of FIG. 7.
Figure 9:
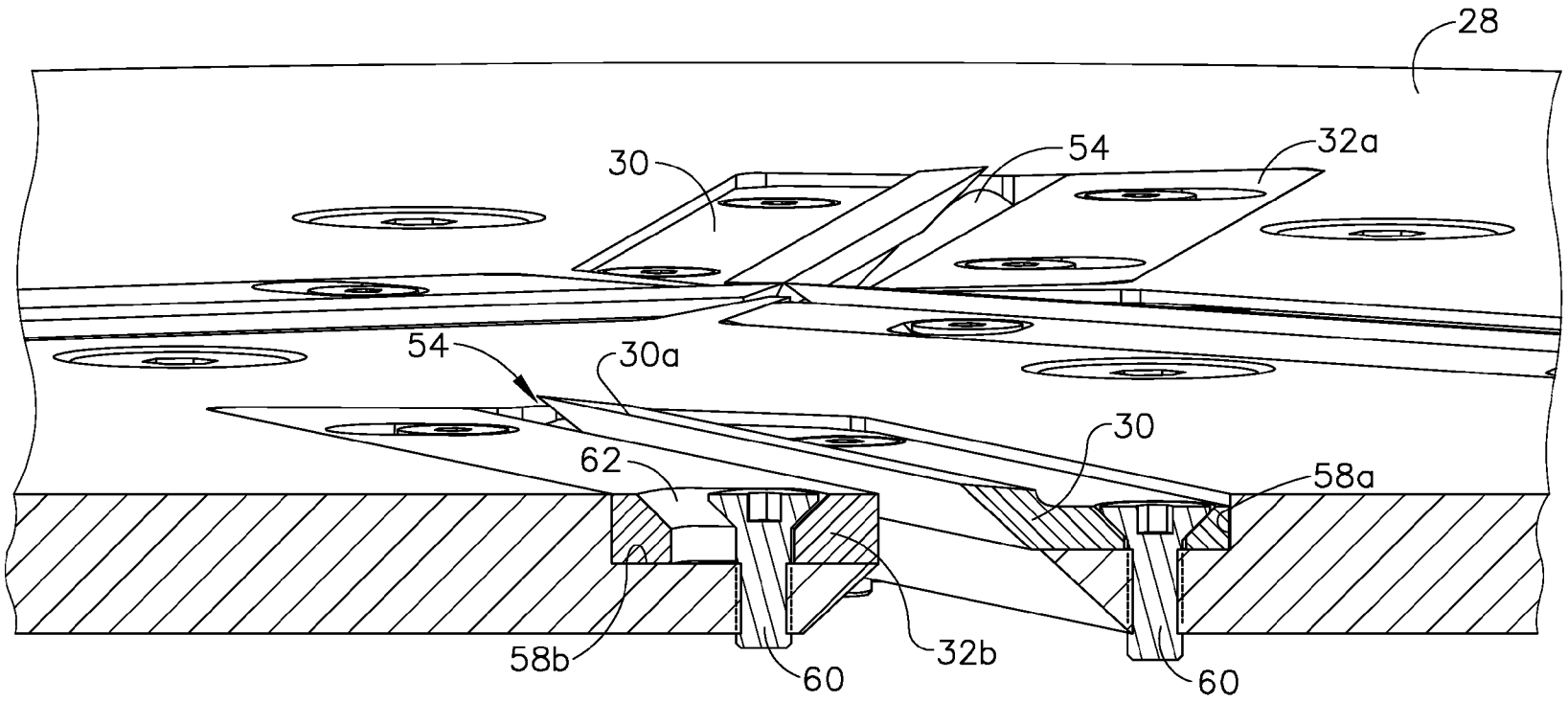
FIG. 9 is a perspective cross-sectional view of a blade and adjustable slide of the rotatable carrier of FIG. 7.
Figures 10A, 10B, 10C:
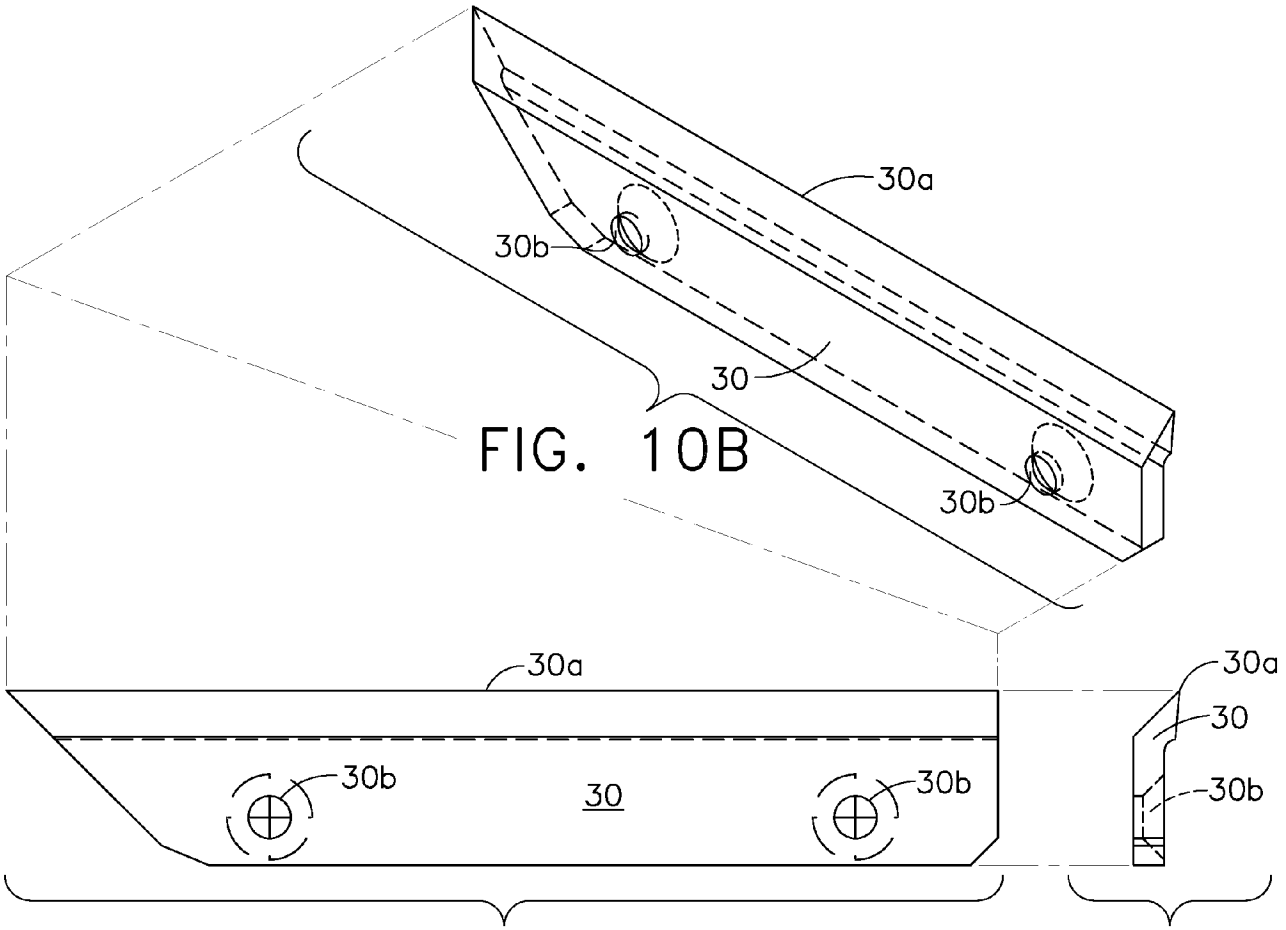
FIGS. 10A, 10B and 10C are side, perspective and end views of a blade of the rotatable carrier of FIG. 7.
Figure 12:
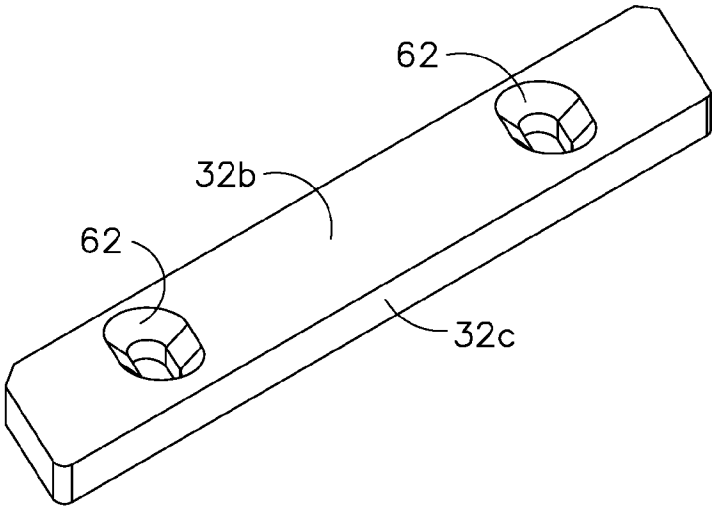
FIG. 12 is a perspective view of the outer adjustable slide of the rotatable carrier of FIG. 7.
Figure 11:
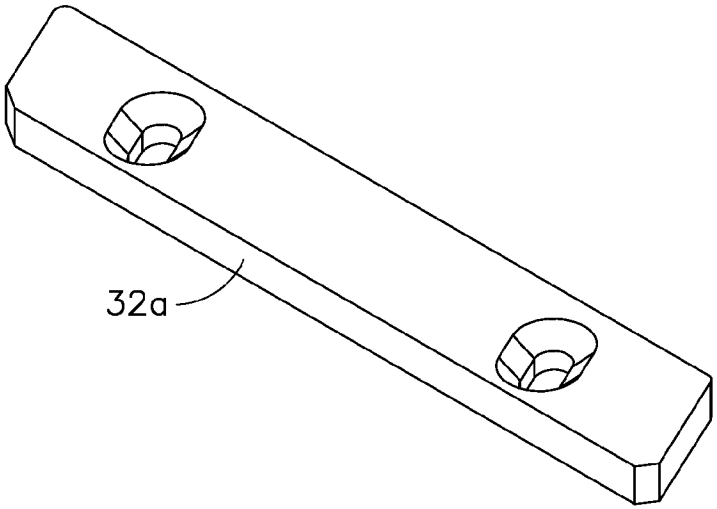
FIG. 11 is a perspective view of the inner adjustable slide of the rotatable carrier of FIG. 7.

Referring to FIGS. 7-9, rotatable carrier 28 includes a plurality of respective openings 54 defined between respective pairs of spaced working edges 30 and slides 32*a*, 32*b*. Pairs of working edges 30 and slides 32*a* are disposed in a first plurality of respective inner recesses 56*a*, 56*b* formed at the inner portion of rotatable carrier 28, and pairs of working edges 30 and slides 32*b* in a second plurality of respective outer recesses 58*a*, 58*b*. As seen in FIGS. 9, 10A, 10B and 10C, working edge 30 includes elongated raised cutting edge 30*a* which is disposed facing slides 32*b*. Working edge 30 includes a plurality of openings 30*b* into which fasteners 60 are disposed to secure working edge 30 in recess 58*a*. Any suitable opening 30*b* and fastener 60 may be used, which in the depicted embodiment are closely confirming to each other so as to hold working edge 30 in a single location (subject to tolerance). Referring also to FIG. 12, outer slide 32*b* includes elongated surface 32*c* which is disposed opposite cutting edge 30*a*. Slide 32*b* includes a plurality of openings into which fasteners 60 as disposed to secure slide 32*b* in recess 58*b*. As seen in FIG. 11, slide 32*a* has a similar construction as slide 32*b*, it being noted that the differences between the inner and outer slides arises from the geometry of openings 56*a*/56*b* and 58*a*/58*b*.

Slide 32*b* is configured to be disposed at a first position as seen in FIG. 9, at which the width of opening 54 is at its largest, and a second position at which the width of opening 54 is at its smallest. It is within the scope of this invention for slide 32*b* to be disposed at a plurality of positions between the first and second positions, whether configured as indexed positions or infinite positions. Such range of positions is accomplished through the mount configuration, which in the embodiment depicted encompasses openings 62 being configured as elongated slots into which fasteners 60 are disposed to secure slide 32*b* positionably within outer recess 58*b*. Slide 32*a* is similarly configured to be positionable.

When slide 32*a* or 32*b* is in the first position, at which opening 54 is at its largest, larger particles may pass through the larger gap. This allows pellets to pass through opening 54 as rotatable carriage 28 is rotated, permitting pellets to be used, disposed in storage bin 14 and transported to feeder assembly 12. Pellets being dispensed may also be reduced in size as they pass between working edges and spacers.

For blocks of solid material, slides 32*a*, 32*b* are disposed in the second position, at which opening 54 is at its smallest. Moving working edges 30 engage the block disposed in bin 14, with the relative motion causing particles to be generated (created), whether by shaving the block. Small particles could also be generated from pellets when slides 32*a*, 32*b* are in the second position.

Figure 13:
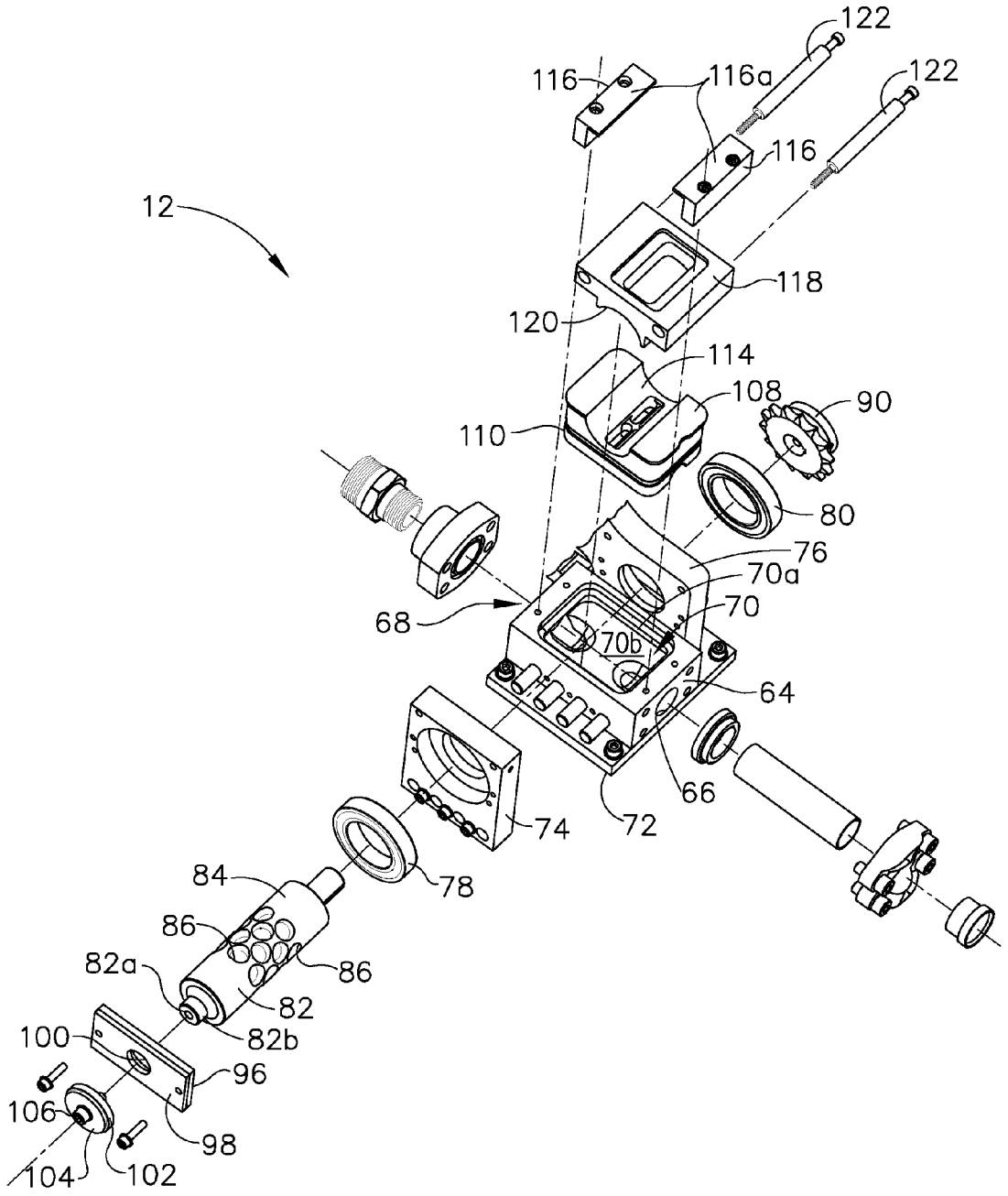
FIG. 13 is an exploded perspective view of the feeder assembly of the particle blast apparatus of FIG. 1.
Figure 14A:
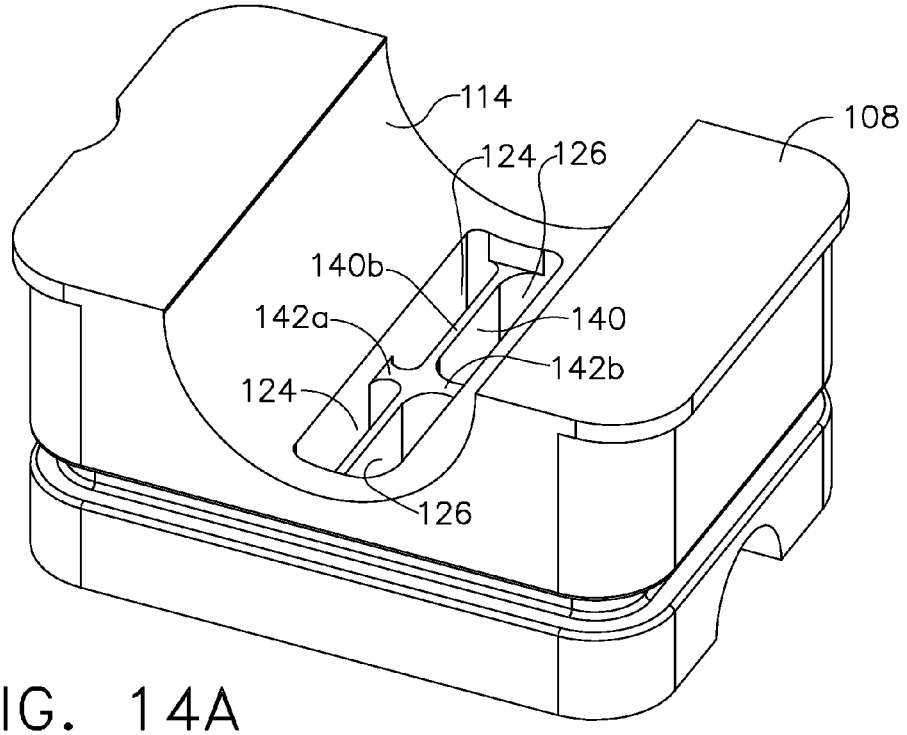
FIG. 14A is a perspective view of the lower seal of the feeder assembly of FIG. 13.
Figure 14B:
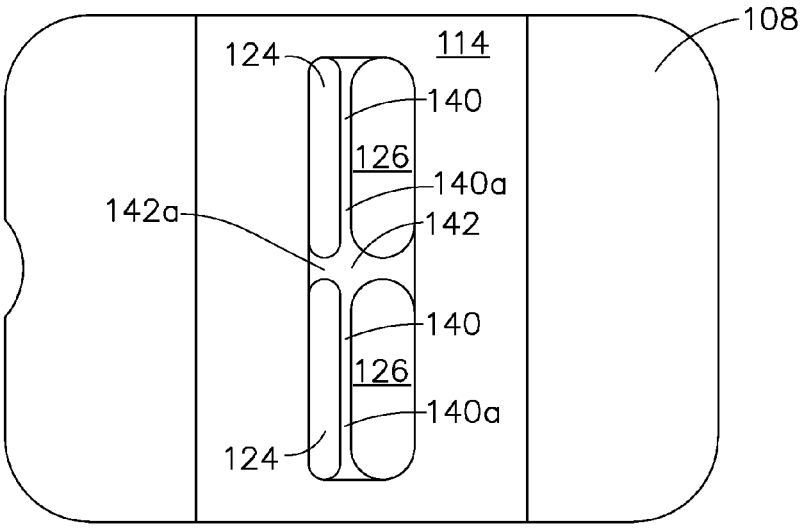
FIG. 14B is a top view of the lower seal of the feeder assembly of FIG. 13.

Referring to FIGS. 13, 14A and 14B, feeder assembly 12 includes feeder block 64 in which inlet 66 and outlet 68 are formed. Feeder block 64 includes cavity 70 defined by wall 70*a* and bottom 70*b*. Feeder block 64 is secured to plate 72 which may be secured to the frame of apparatus 2. A pair of spaced apart bearing supports 74, 76 respectively carry axially aligned sealed bearings 78, 80.

Rotor 82 may be from any suitable material and is depicted as a cylinder, although various other shapes, such as frustoconical may be used. Threaded hole 82*a* is formed in the end of rotor 82. Rotor 82 includes peripheral surface 84 in which a plurality of spaced apart pockets 86 are formed. In the embodiment shown, there are four circumferential rows of pockets 86, with each circumferential row having six pockets 86. Pockets 86 are also aligned in axial rows, with each axial row having two pockets 86. The axial and circumferential rows are arranged such that the axial and circumferential widths of pockets 86 overlap, but do not intersect, each other.

Figure 4:
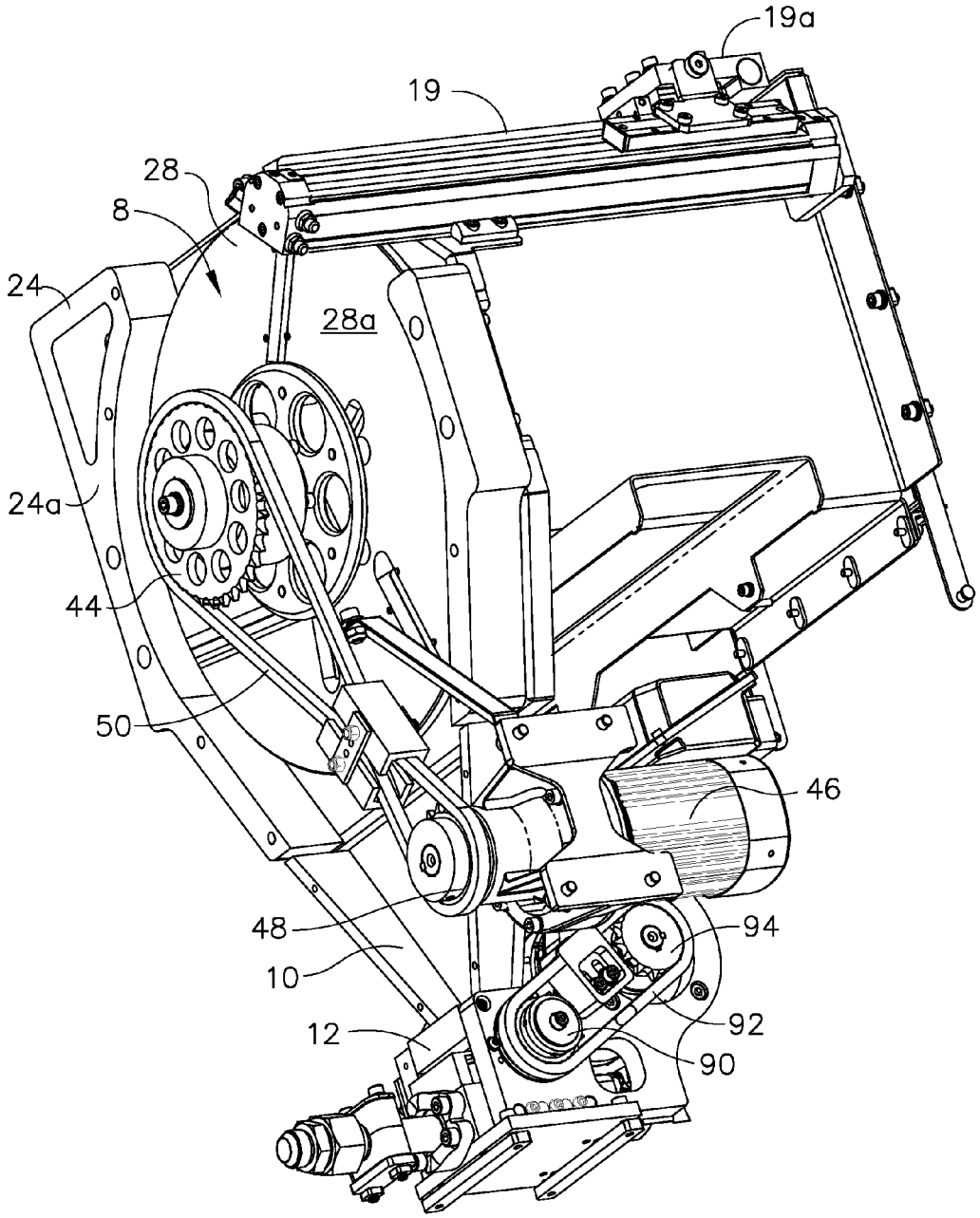
FIG. 4 is a perspective view from the lower right front illustrating the particle generator and feeder assembly of the particle blast apparatus of FIG. 1.

In this embodiment, rotor 86 is rotatably carried by bearings 78, 80, for rotation by motor 88 (see FIGS. 2-4). Drive member 90 is connected to rotor 86 and is driven via drive element 92, which is driven by drive member 94 carried by motor 88. Thrust bearing plate 96 and retaining plate 98 are disposed at one end. Thrust bearing plate 96 may be made of any suitable material, such as UHMW plastic. Rotor hub 82*b* extends through opening 100 of thrust bearing plate 96 and retaining plate 98, engaging retainer bearing disc 102 which is backed by retainer 104 by fastener 106 extending therethrough, threadingly engaging threaded hole 82*a* so as to retain rotor 86. The fit between bearings 74, 76 and rotor 82 allows rotor 82 to be easily withdrawn from feeder assembly 12 by unscrewing fastener 106 and sliding rotor out through bearing 76.

Lower seal pad 108 is disposed partially in cavity 70, with seal 110, located in groove 112, sealingly engaging groove 112 and wall 70*a*. Lower seal pad 108 includes surface 114 which, when assembled, contacts peripheral surface 84 of rotor 82, forming a seal therewith, as described below. Brackets 116 are attached to block 64 by fasteners (not shown), and have portions 116*a* which overly the upper surface of lower seal 108 so as to retain lower seal 108 to block 64. As used herein, "pad" is not used as limiting: "Seal pad" refers to any component which forms a seal.

Upper seal pad 118 includes surface 120 which, when assembled, contacts peripheral surface 84 of rotor 82. Fasteners 122 are disposed through holes in upper seal pad 118 to hold it in place, without significant force being exerted by surface 120 on rotor 82.

Upper seal pad 118 and lower seal pad 108 may be made of any suitable material, such as a UHMW material. The ends of surfaces 114 and 120 adjacent bearing 80 may be chamfered to allow easier insertion of rotor 82

Figure 15:
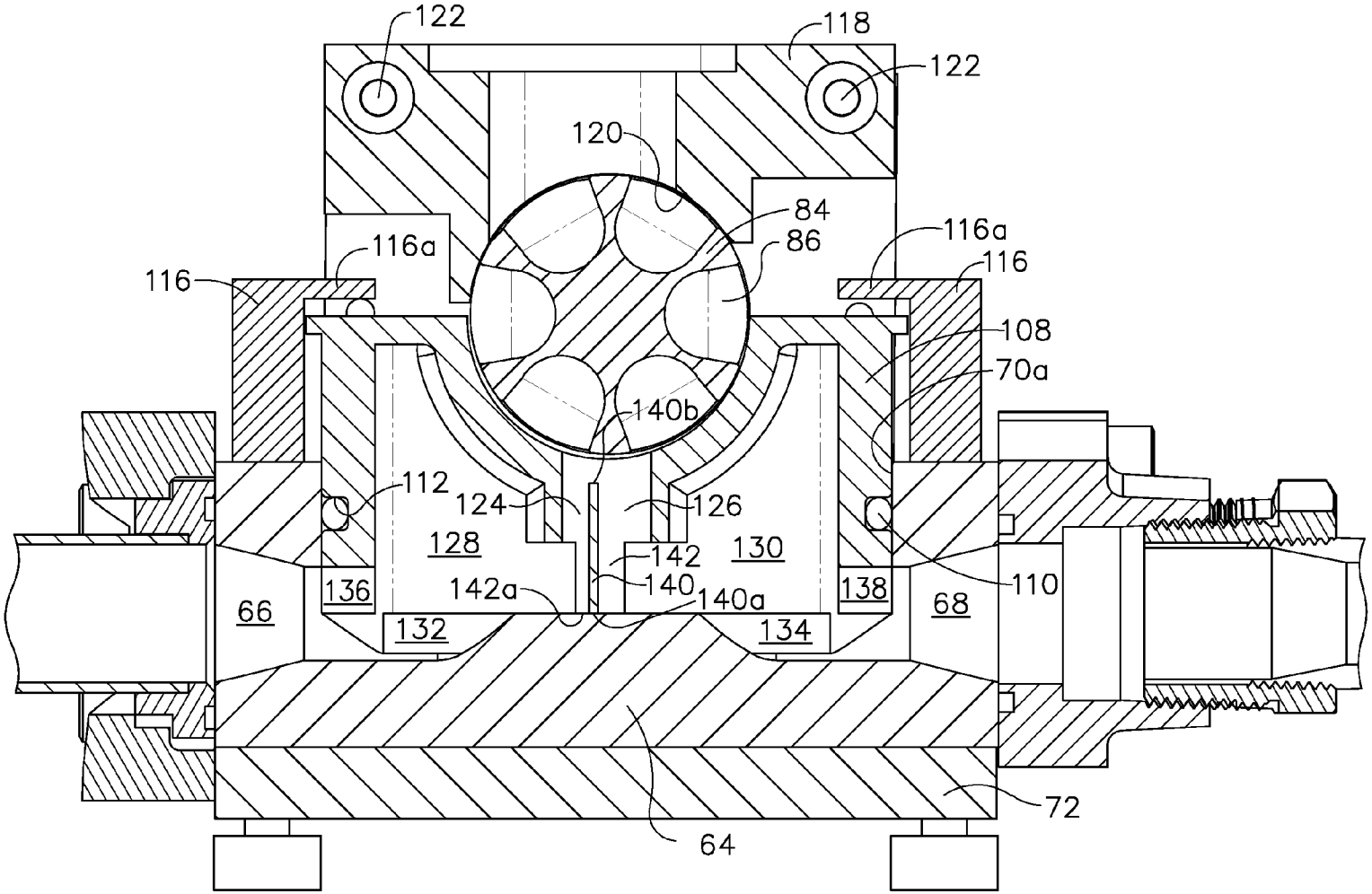
FIG. 15 is a cross-sectional view of the feeder assembly of the particle blast apparatus of FIG. 1.

Referring also to FIG. 15, lower pad seal 108 is shown disposed in cavity 70, with seal 110 engaging wall 70*a*, and upper pad seal 118 overlying but not engaging lower pad seal 108, surface 120 engaging rotor 82. Surface 114 includes two openings 124 which are in fluid communication with inlet 66 through upstream chamber 128, and two openings 126 which are in fluid communication with outlet 68 through downstream chamber 130. It is noted that although two openings 124 and two openings 126 are present in the illustrated embodiment, the number of openings 124 and openings 126 may vary, depending on the design of feeder assembly 12. For example, a single opening may be used for each. Additionally, more than two openings may be used for each.

Feeder assembly 12 has a transport gas flowpath from inlet 66 to outlet 68. In the depicted embodiment, passageways 132 and 134 are formed in feeder block 64. Lower seal pad 108 includes recess 136, which is aligned with inlet 66 and together with passageway 132, places upstream chamber 128 in fluid communication with inlet 66. Lower seal pad 108 also includes recess 138, which is aligned with outlet 68 and together with passageway 134, places downstream chamber 130 in fluid communication with outlet 68.

Upstream chamber 128 is separated from downstream chamber 130 by wall 140 which extends transversely across lower seal pad 108. Lower surface 140*a* of wall 140 seals against bottom 70*b* of cavity 70, keeping upstream chamber 128 separate from downstream chamber 130. Wall 142 is disposed perpendicular to wall 140, with lower surface 140*a* engaging bottom 70*b*.

As illustrated, in the depicted embodiment, inlet 66 in fluid communication with outlet 68 substantially only through individual pockets 86 as they are cyclically disposed by rotation of rotor 82 between a first position at which an individual pocket first spans openings 124 and 126 and a second position at which the individual pocket last spans openings 124 and 126. This configuration directs substantially all of the transport gas entering 66 to pass through pockets 86, which pushes the blast media out of pockets 86, to become entrained in the transport gas flow. Turbulent flow occurs in downstream chamber 130, promoting mixing of media with the transport gas. Such mixing of the media entrains the media in the transport gas, minimizing impacts between the media and the feeder components downstream of the pockets. The significant flow of the transport gas through each pocket 86 acts to effectively clean all media from each pocket 86.

It is noted that there is a gap above top 140*b* of wall 140 and top 142*b* of wall 142 and peripheral surface 84 of rotor 82. Some transport gas flows across tops 140*b* and 142*b* from upstream chamber 128 to downstream chamber 130.

Particles generated by action of working edges 30 across a block or a plurality of pellets disposed in storage bin 14, or particles passed through openings 54, travel directly through collector chamber 52 and internal passageway 10*c* into feeder assembly 12. The speeds of motor 46 and motor 88 are controlled such that the displaced volumetric rate of pockets 86 is greater than the particle capacity of rotatable carrier 28 and associated parts at maximum speed. Thus, such particles reach feeder assembly 12 without being held or stored for any appreciable time period.

Single Motor Embodiment

Figure 16:
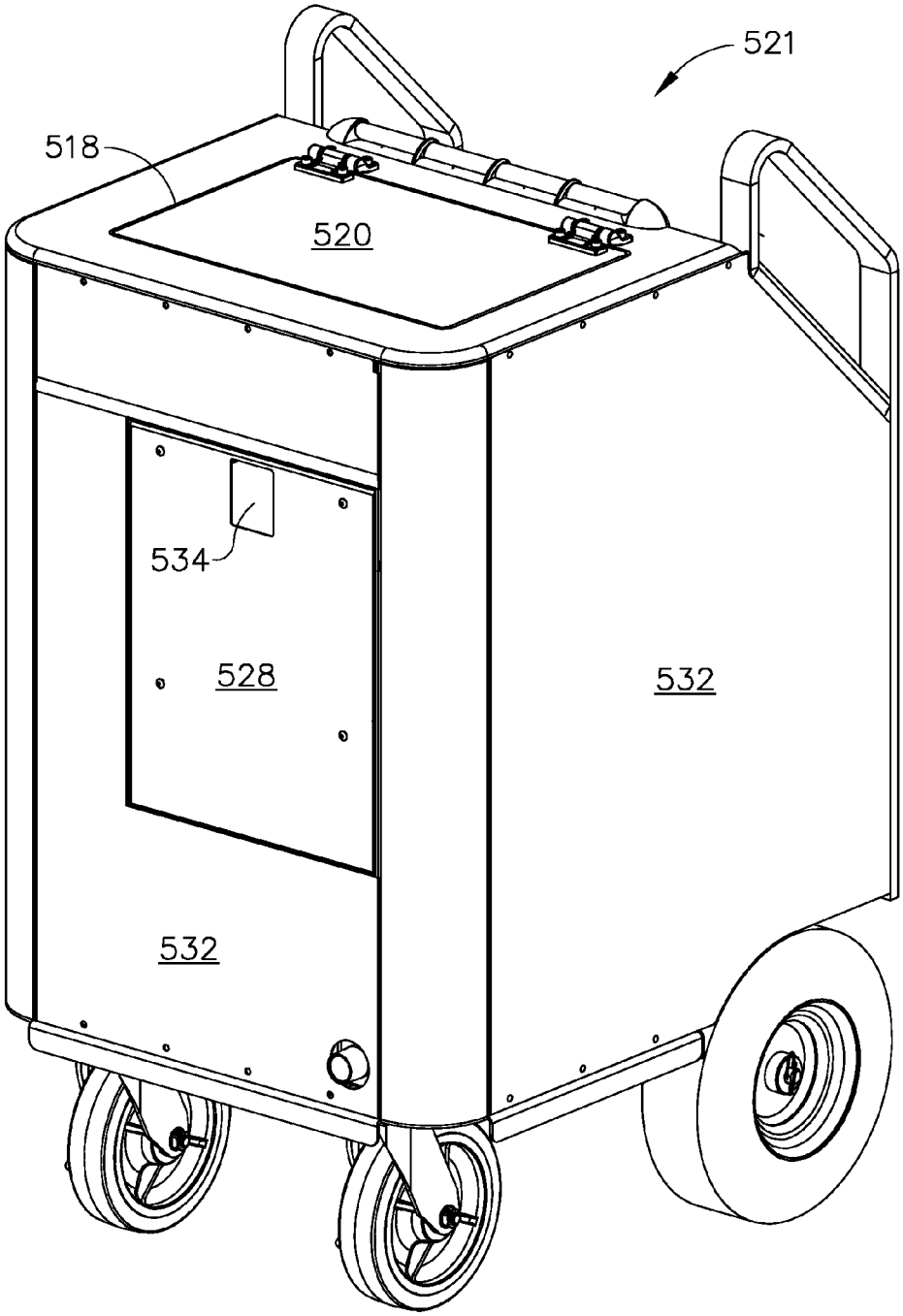
FIG. 16 is a perspective view from the left front of a particle blast apparatus constructed in accordance with teachings of the present invention.
Figure 17:
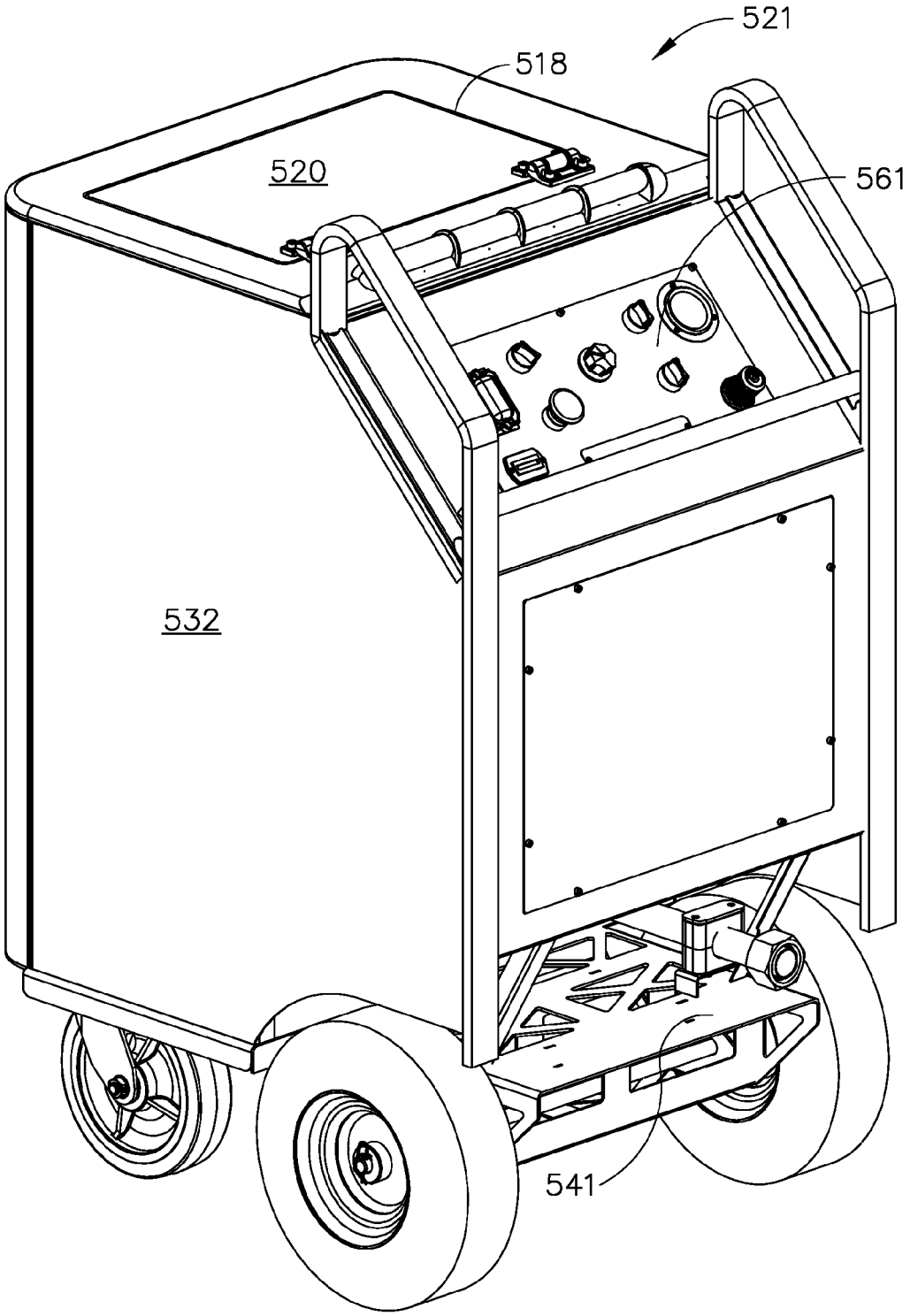
FIG. 17 is a perspective view of the particle blast apparatus of FIG. 16 from the left rear.

FIGS. 16 and 17 show perspective views of a particle blast apparatus constructed in accordance with teachings of the present invention. Particle blast apparatus, generally indicated at 521, includes frame 541 which carries and supports the individual components, as will be described below. Control panel 561 is located at the rear of particle blast apparatus 521 for use by the user to control the particle blast apparatus through a valves, switches, and timers. The valves, switches, timers, and controls can be pneumatic, electric, or any combination thereof.

Figure 18:
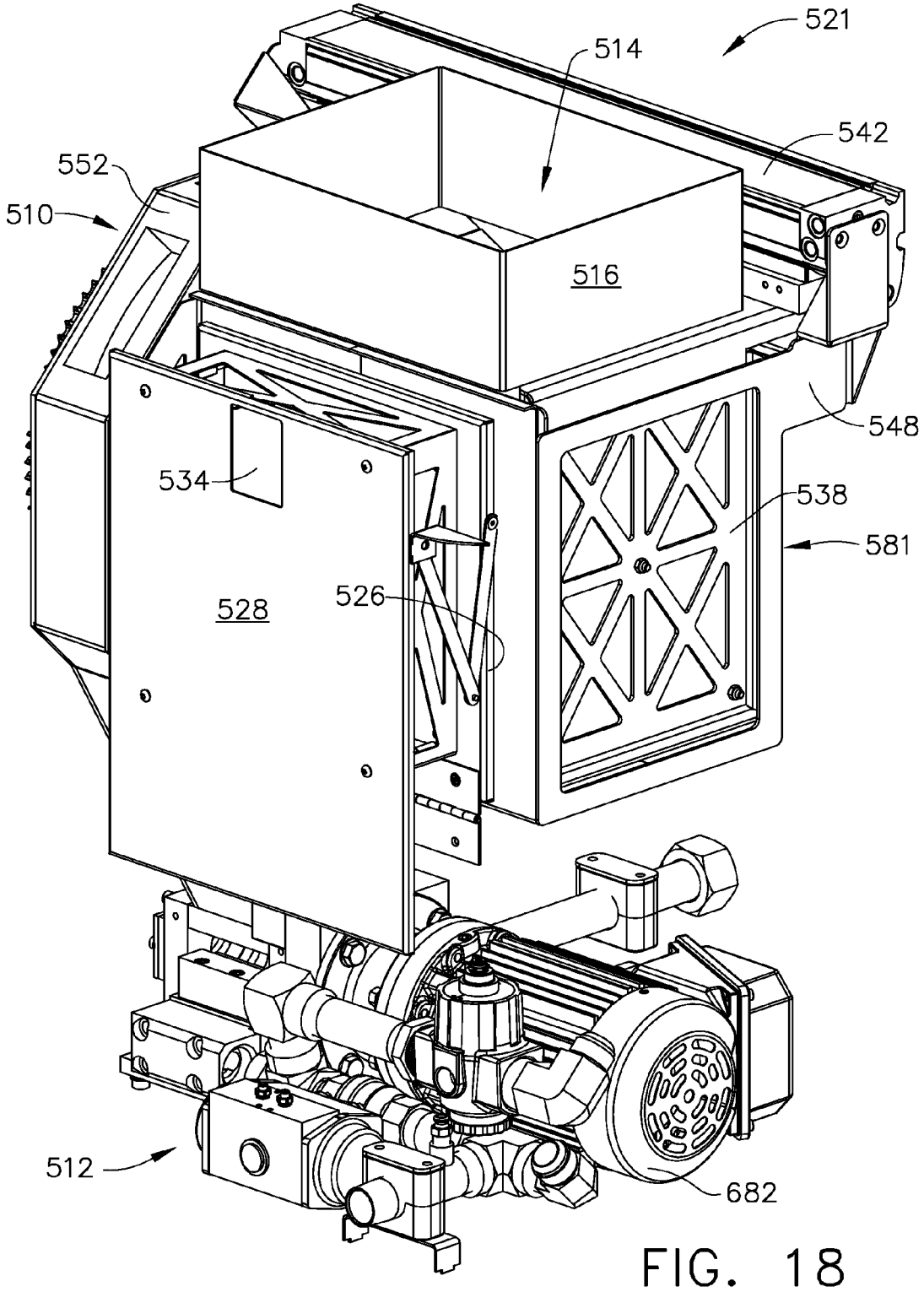
FIG. 18 is a perspective view from the left front illustrating the supply bin of the particle blast apparatus of FIG. 16.
Figure 19:
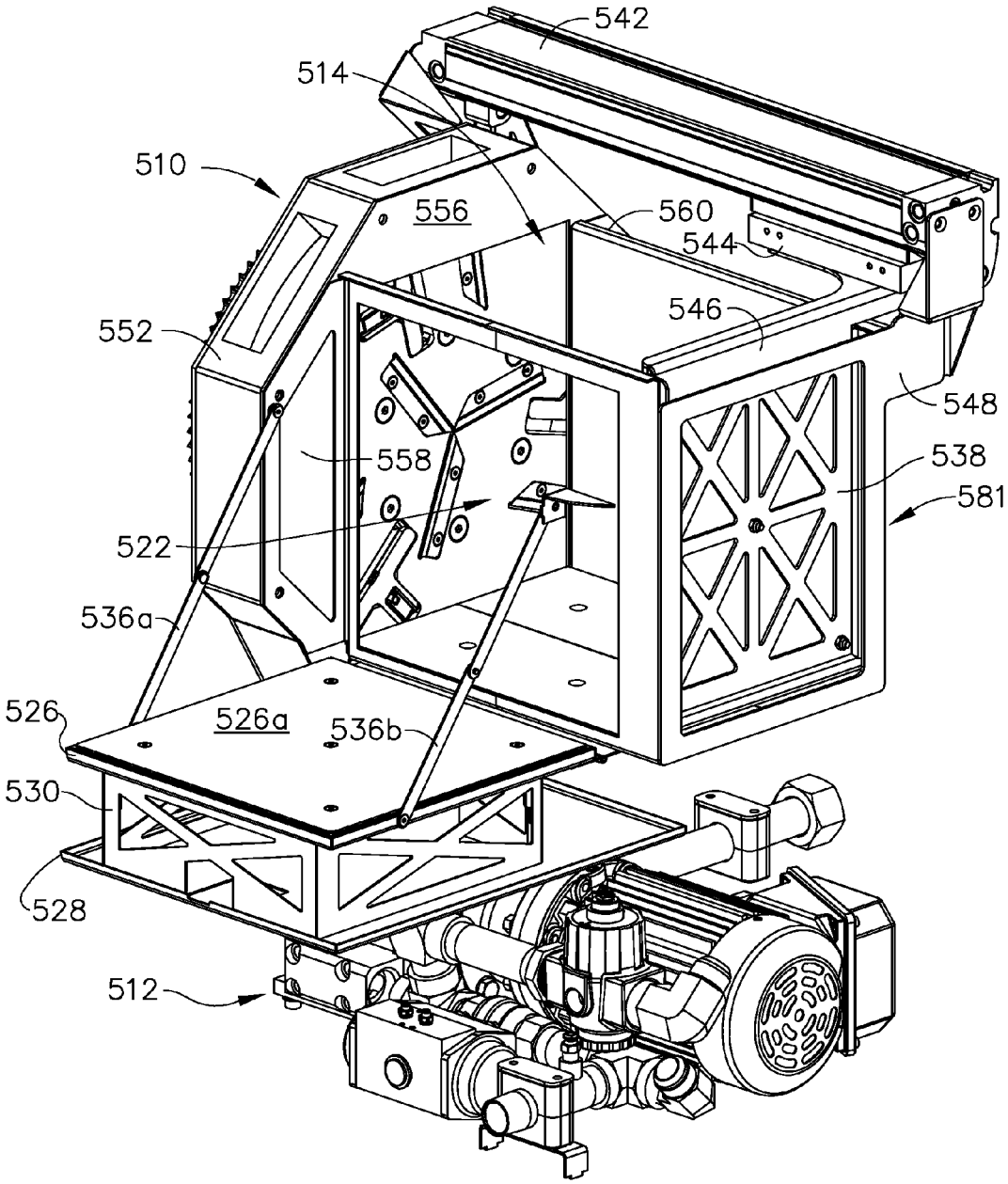
FIG. 19 is a perspective view similar to FIG. 18, with the door in the lower position.
Figure 20:
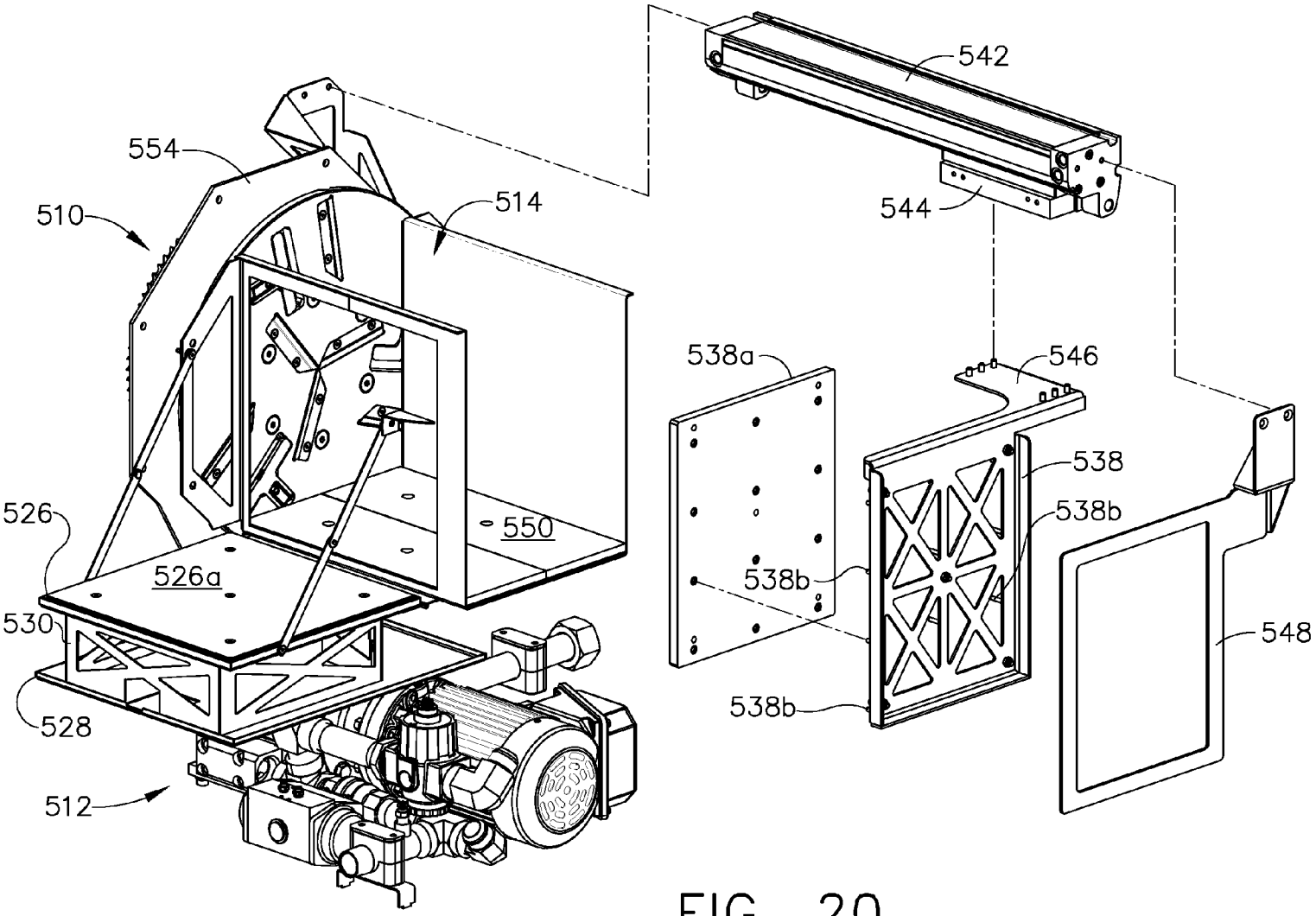
FIG. 20 is an perspective view similar to FIG. 5 with the linear actuator, pressure plate and rear cover exploded from the rest of the particle generator and feeder assembly.

Referring to FIGS. 18-20, there is shown a perspective view of the assembly including supply bin 581, particle generator 510 and feeder assembly 512. Bin 581 is configured to receive a block of solid carbon dioxide of any suitable size, particularly but not limited to standard commercially available blocks of dry ice, e.g., 10" ×10" ×12", or to receive loose particles such as preformed pellets. Loose particles may be loaded into supply bin 581 through top opening 514, which in the embodiment depicted may include shroud 516 surrounding opening 514 and extending upwardly aligned with opening 518, which may be selectively covered or uncovered by lid 520. A block of solid carbon dioxide may be loaded into supply bin 8 through top opening 514, or loaded through side opening 522.

Movable door assembly 524 may be disposed at a first position at which side opening 522 is covered, functioning to retain solid carbon dioxide, whether loose particles or a solid block, within supply bin 581, forming a side thereof. Movable door assembly 524 is movable to a second position at which sufficient access to side opening 522 exists to load carbon dioxide into supply bin 581. It is noted that loose particles of carbon dioxide could be loaded through side opening 522, with an appropriate configuration of movable door assembly 524.

In the depicted embodiment, movable door assembly 524 includes inner door 526 which is hingedly connected to supply bin 581 to rotate about a horizontal axis from the vertical position, essentially forming a wall of supply bin 581, to the horizontal position, forming a shelf on which a block of dry ice could be supported and then slide into supply bin 581. Movable door assembly 524 includes outer door 528 carried by and spaced apart from inner door 526 by spacer 530 which is secured to inner door 526. Outer door 528 may thus be aligned with the outer skin 532 of particle blast apparatus 521. This configuration of movable door assembly 524 cooperates with the complementary shaped opening in skin 532 to accommodate the fact that outer door 528 pivots about an offset axis, not about its lower edge, thereby producing rotation and translation. Thus the lower edge of outer door 528 is lower than the pivot axis, approximately by the distance between outer door 528 and inner door 526 defined by spacer 530, causing the lower edge of outer door 528 to move inside of outer skin 532 as movable door assembly is rotated. Of course, any suitable configuration may be used to accomplish the function of movable door assembly.

Latch 534 may be included to hold movable door assembly 524 in the vertical position. Support arms 536*a* and 536*b* extend between movable door assembly 524 and frame 541 (not seen in FIGS. 19-21) to support movable door assembly 524 in the horizontal position. Although support arms 536*a* and 536*b* are depicted as respective folding assemblies pivoting about each member's ends, support arms 536*a* and 536*b* may have any suitable configuration, such as retractable or non-retractable cables.

The rear wall of supply bin 581 is defined by moveable pressure plate 538, which is configured to urge any material, whether a block or a plurality of individual particles, disposed within supply bin 581, toward rotatable carrier 540 of particle generator 510 so as to cause such material to remain in contact with rotatable carrier 540 with sufficient force for particle generator to generate particles for introduction into the transport gas flow, as described below. Pressure plate 538 may be resiliently biased toward rotatable carrier 540 and/or may be actively urged and moved there towards, and may, as depicted, include a plurality of projections 538*b*. Actuator 542 may be disposed adjacent supply bin 581, and configured to move pressure plate 538 toward and away from rotatable carrier 540 of particle generator 510. In the embodiment depicted, actuator 542 is a linear actuator and includes carriage 544 which is connected to pressure plate 538 by arm 546 extending from carriage 544. Non-moving member 548 may be provided, in the embodiment depicted attached to actuator 542.

Excluding rotatable carrier 540, the spaced apart interior surfaces of supply bin 581 may be made of any suitable material, preferably which resists the material disposed within bin 581 from sticking to sides 520. Inner door 526 includes liner 526*a*, and pressure plate 538 includes liner 538*a*, which may be made of UHMW plastic. Liner 538*a* as depicted includes a plurality of openings through which projections 538*b* extend. Similarly, bottom 550 may be a liner made of UHMW. Other suitable materials, such as smooth stainless steel may be used.

It is noted that the configuration of supply bin 581 is not limited to the embodiment depicted, and may have any configuration suitable to present a supply of media to particle generator 510. For example, supply bin 581 may be configured without sides, suitable for use with a preformed block of carbon dioxide.

Figure 21:
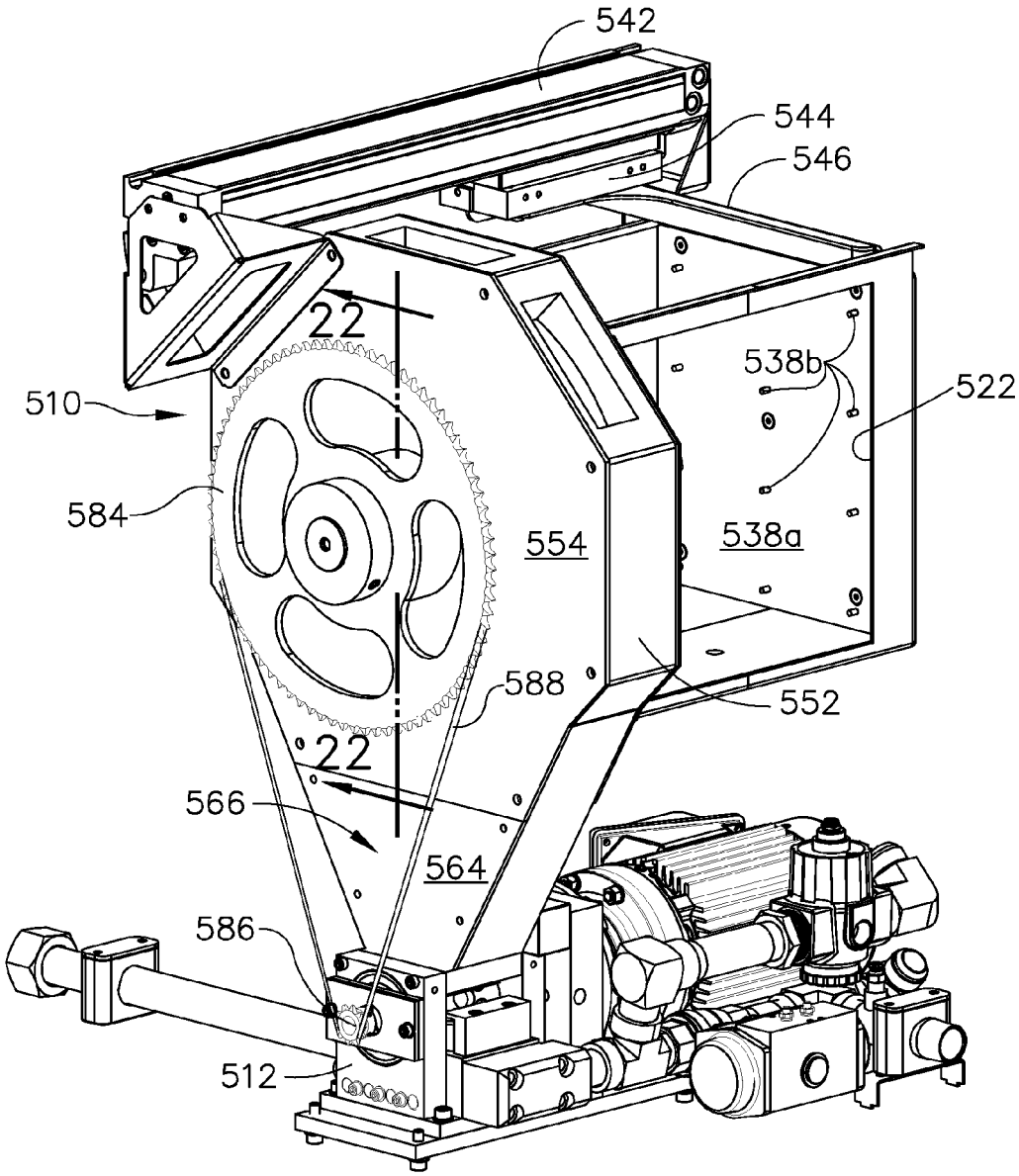
FIG. 21 is perspective view from the right front illustrating the particle generator and feeder assembly with the door omitted.
Figure 22:
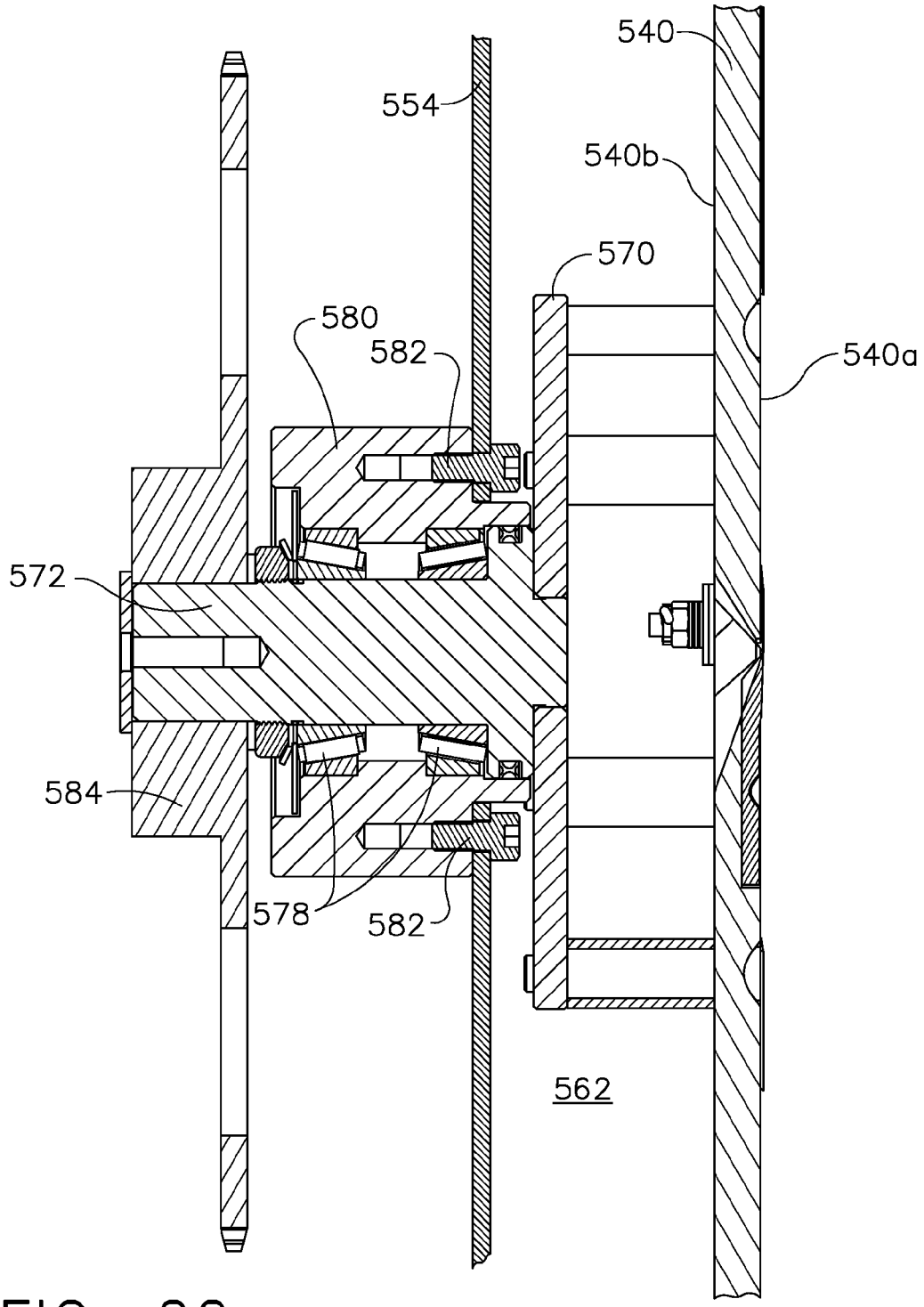
FIG. 22 is a cross-sectional view taken along line 22-22 of FIG. 21.
Figure 23:
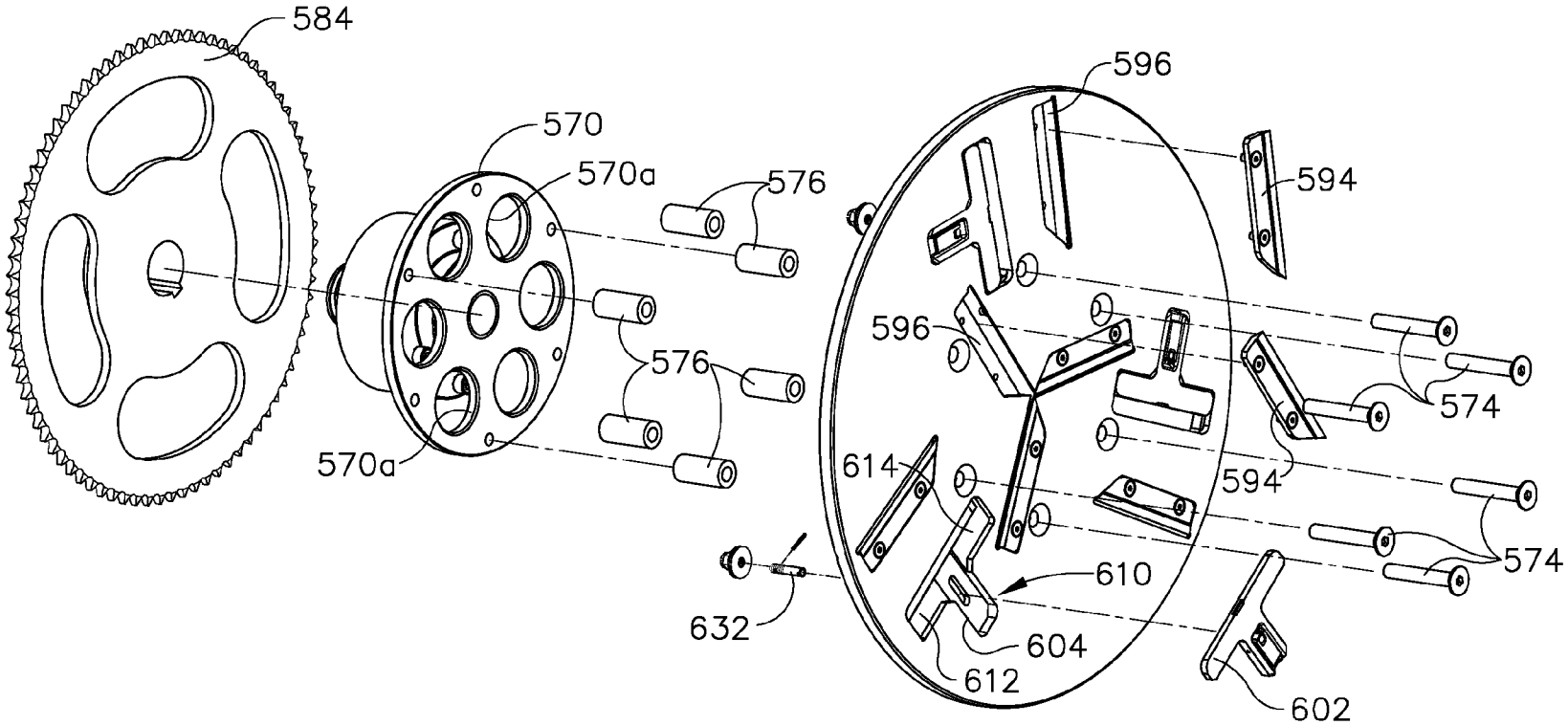
FIG. 23 is an exploded view of the driven element and the rotatable carrier.
Figure 24:
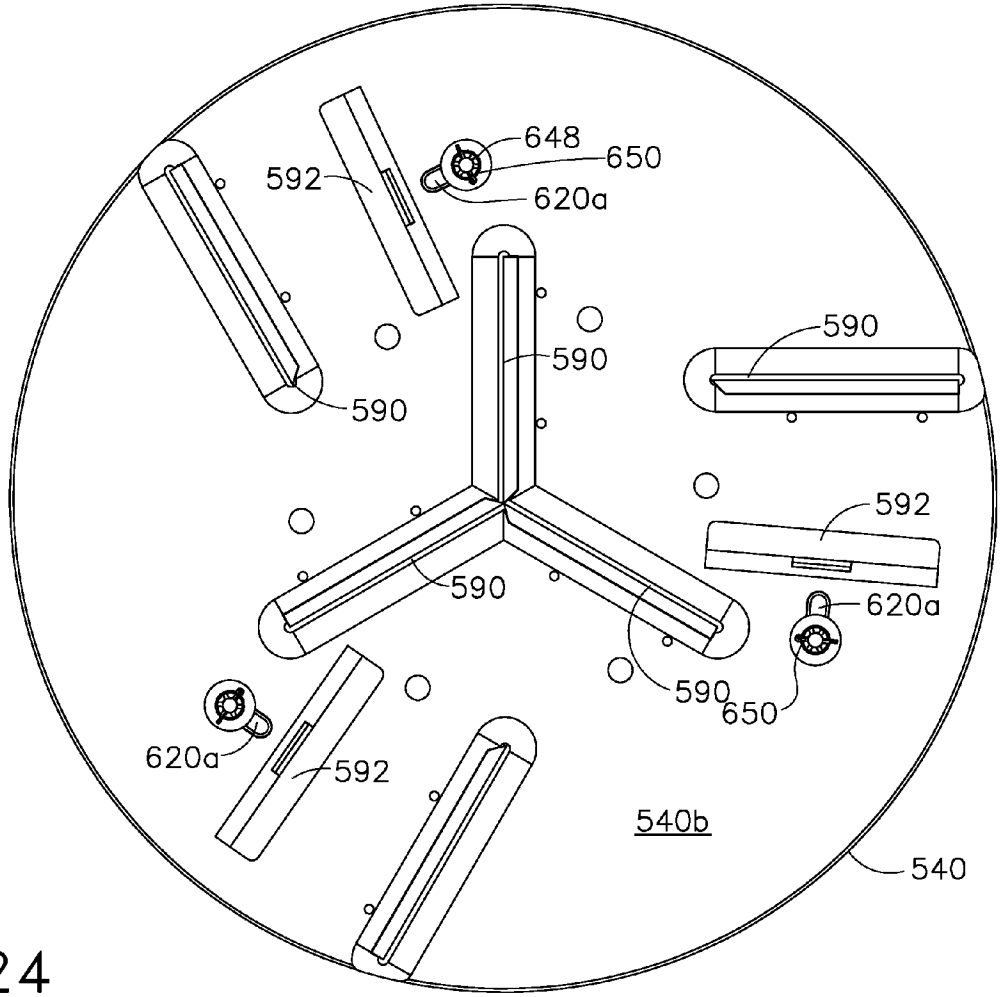
FIG. 24 is a plan view of the outer surface of the rotatable carrier of the particle generator of the particle blast apparatus of FIG. 16.
Figure 25:
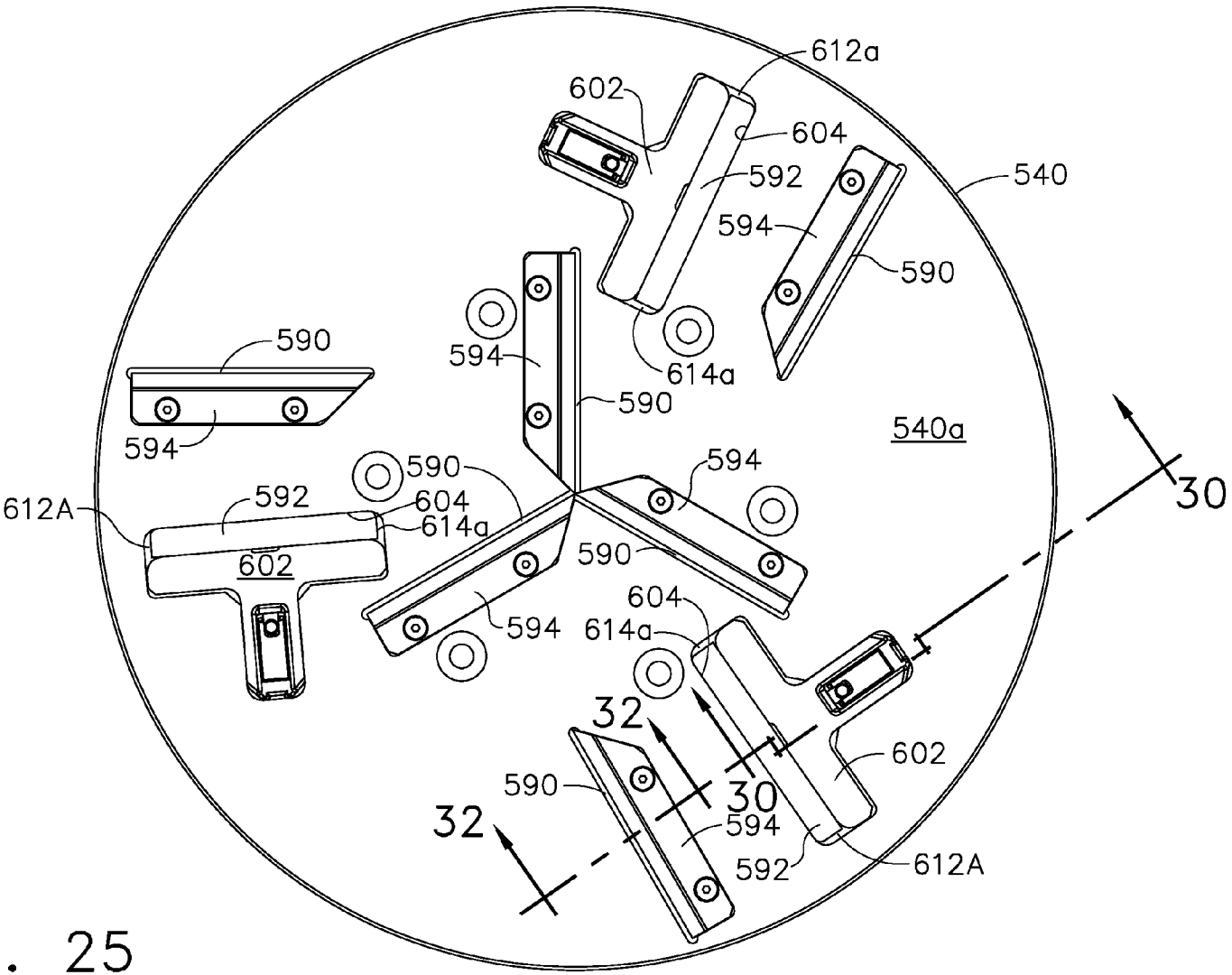
FIG. 25 a plan view of the inner surface of the rotatable carrier of the particle generator of the particle blast apparatus of FIG. 16.
Figure 26:
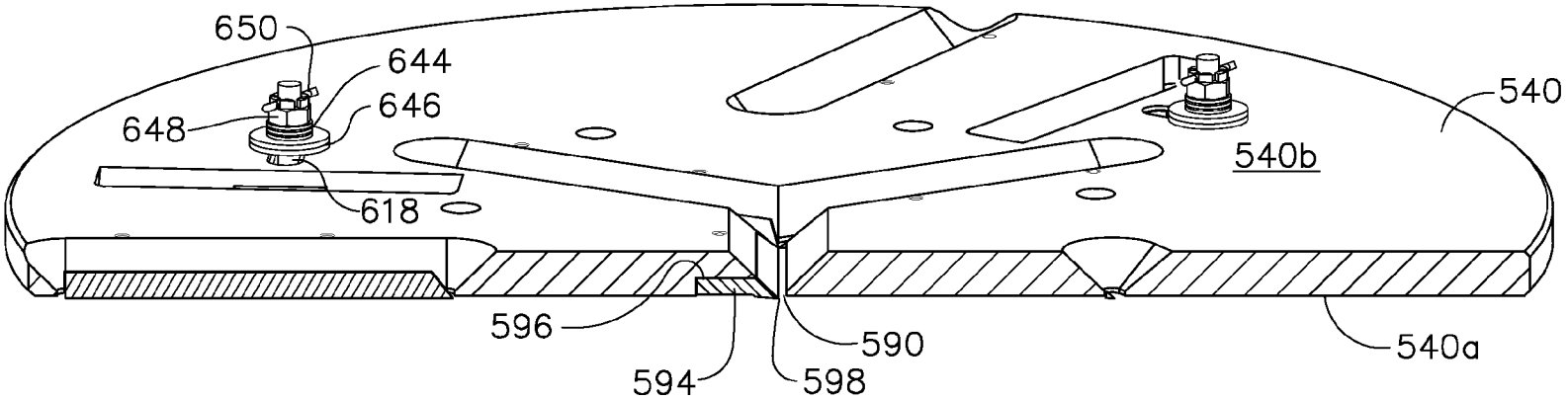
FIG. 26 is a perspective view of the rotatable carrier in partial cross section.
Figure 27:
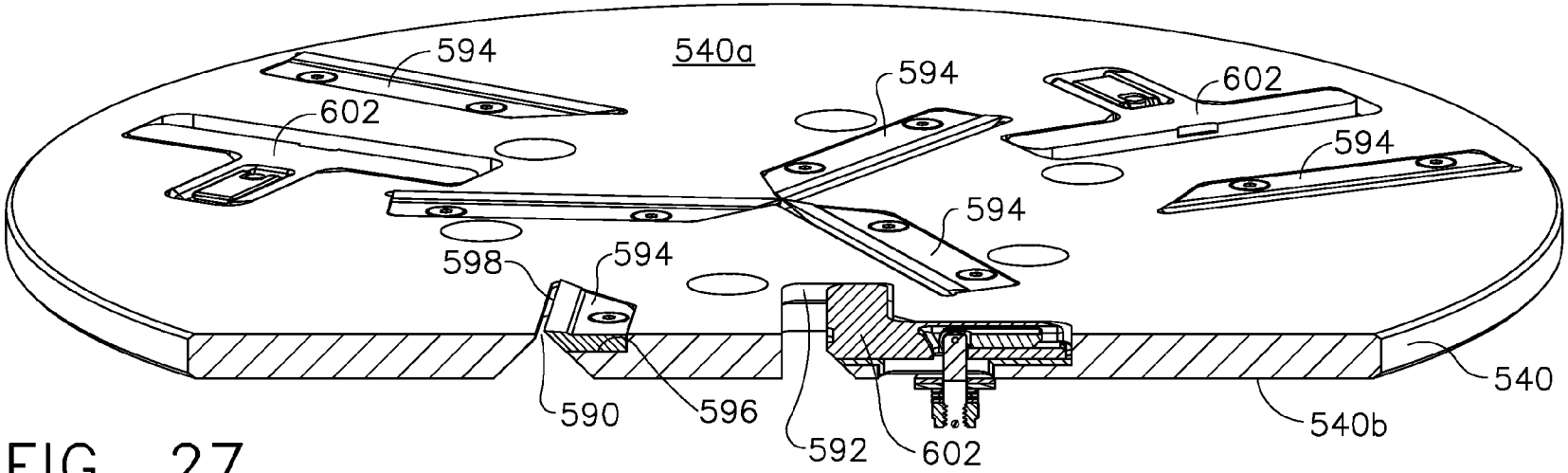
FIG. 27 is a perspective view of the rotatable carrier in partial cross section.
Figure 28:
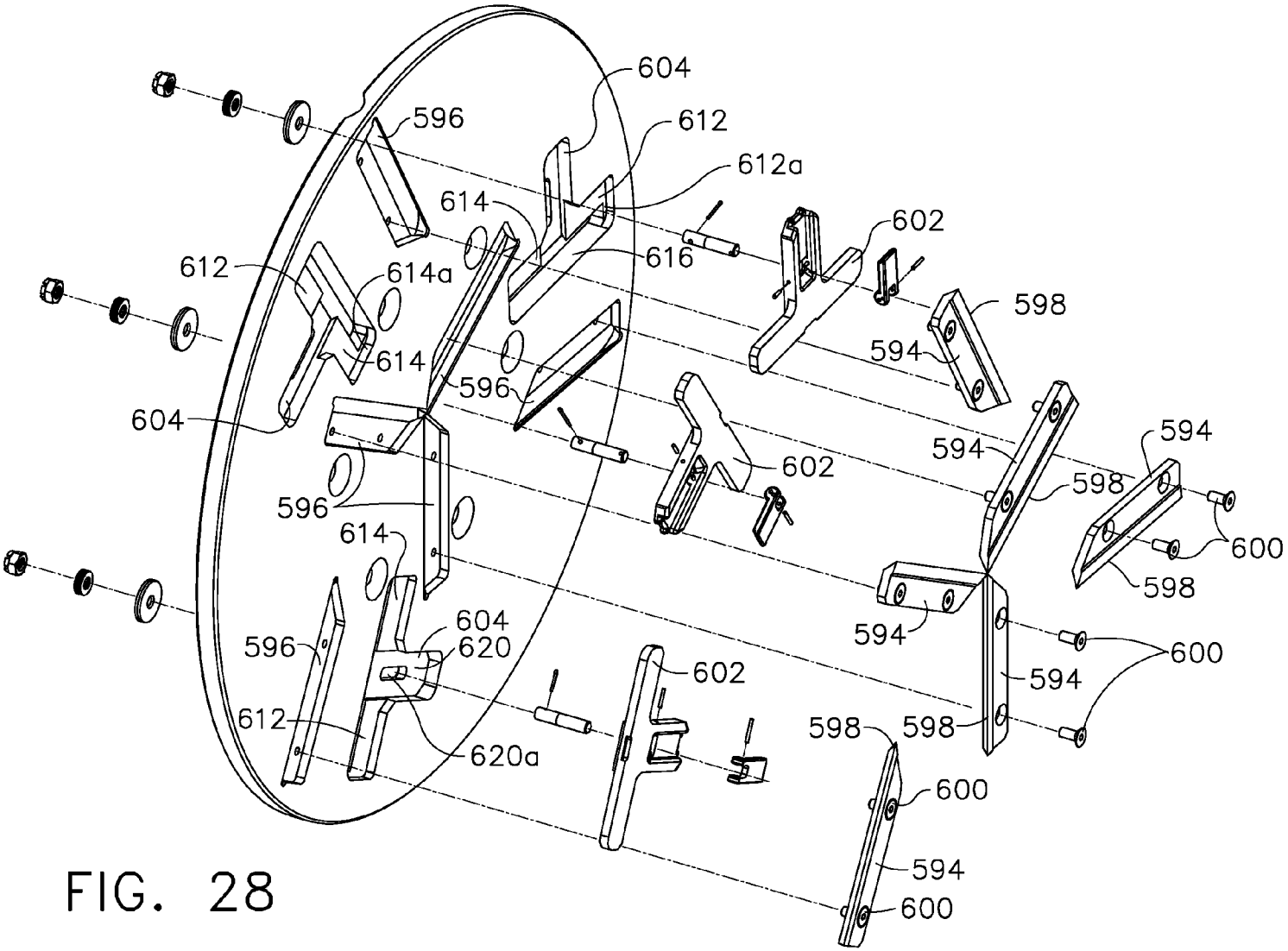
FIG. 28 is an exploded view illustrating the rotatable carrier, working edges and slides.

Referring also to FIGS. 21-23, particle generator 510 includes housing 552 which is secured to supply bin 581. Housing 552 includes front upper cover 554, rear upper cover 556 and rear side covers 558 and 560, which collectively define collector chamber 562. Housing 552 includes lower front cover 564, which collectively define duct 566 which defines internal passageway 568 which places collector chamber 562 in fluid communication with feeder assembly 512. Particles passing through openings (as described below) of rotatable carrier 540 flow into and through collector chamber 562, and into and through internal passageway 568 and to feeder assembly 512.

Rotatable carrier 540 is movable, and in operation moves, relative to supply bin 581 with the material disposed in supply bin 581 being urged against inner surface 540*a* of rotatable carrier 540. The rotation of rotatable carrier 540 results in the generation (or feeding) of particles into collector chamber 562. Therefore, the rate of rotation of rotatable carrier 540 determines the rate at which particles are generated (or fed) into collector chamber 562 into internal passage way 568 and to feeder assembly 512. Rotatable carrier 540 is connected to rotor 570 by a plurality of fasteners 574, with a plurality of spacers 576 establishing space between surface 540*a* of rotatable carrier 540 and rotor 570 through which the generated particles may fall. In the embodiment depicted, rotor 570 has a plurality of holes 570*a* in order to reduce the weight of rotor 570. Rotor 570 also includes hub 572 which carries the inner races of bearings 578 that rotatably support rotor 570. The outer races of bearings 578 are supported by bearing block 580 which is secured to cover 552 by a plurality of fasteners 582.

Hub 572 also carries driven element 584, which is non-rotatably fixed to hub 572. Drive element 586 drives driven element 584 through endless drive element 588, which is configured complementarily with driven element 584 and drive element 586. In the embodiment depicted, driven element 584 and drive element 586 are depicted as toothed elements, such as sprockets, with endless drive element 588 being a toothed belt or chain. Thus the rotation of driven element 584 is synchronized with the rotation of drive element 586. Since the rotation of rotatable carrier 540 is synchronized with the rotation of driven element 584 (in the embodiment depicted 1:1) and since, as described below, the rotation of drive element 586 is synchronized with the rotation of the feeder rotor of feeder assembly 512, the rate at which particles are generated is synchronized with the rotational rate of the feeder rotor.

Figure 32:
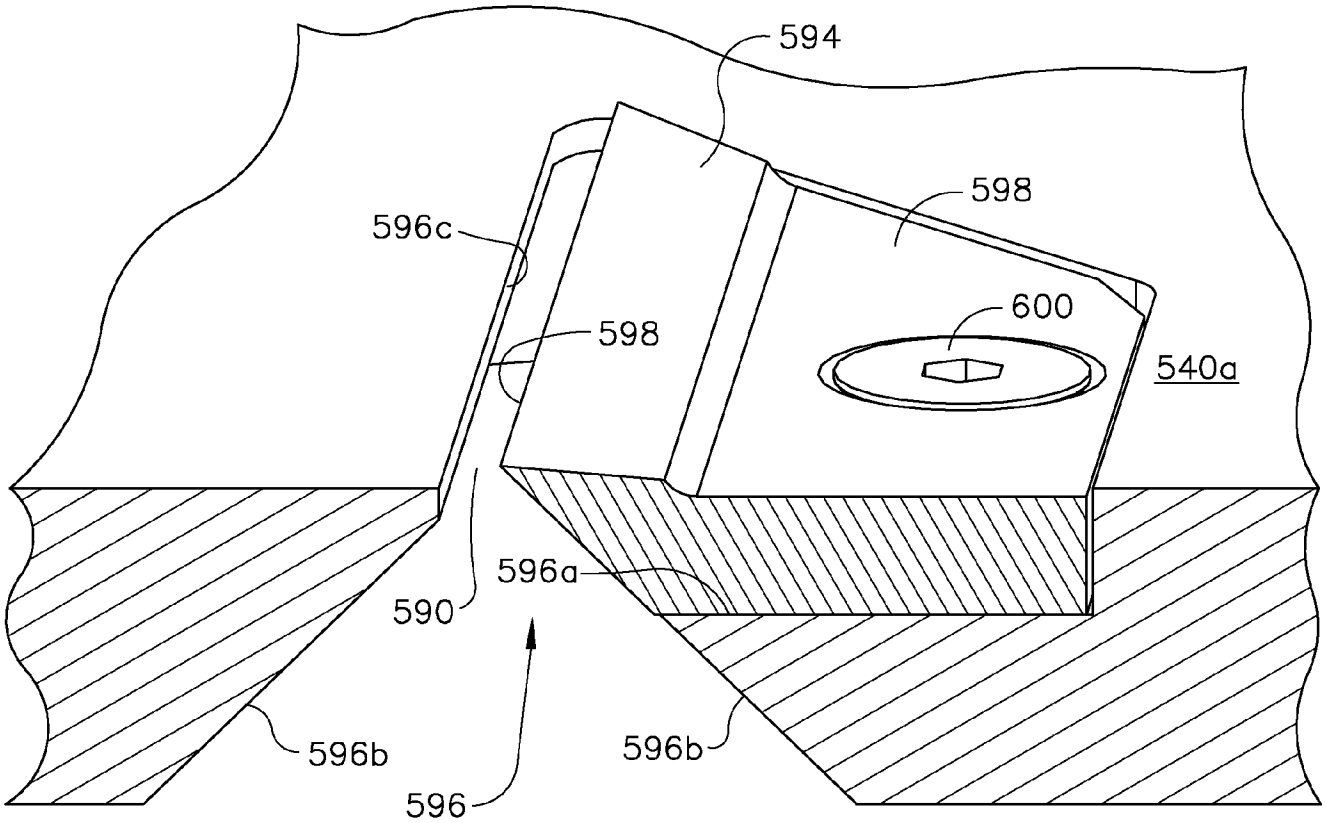
FIG. 32 is a fragmentary perspective view of a working edge of the rotatable carrier and a cross-sectional view taken along line 32-32 of FIG. 25.
Figure 33:
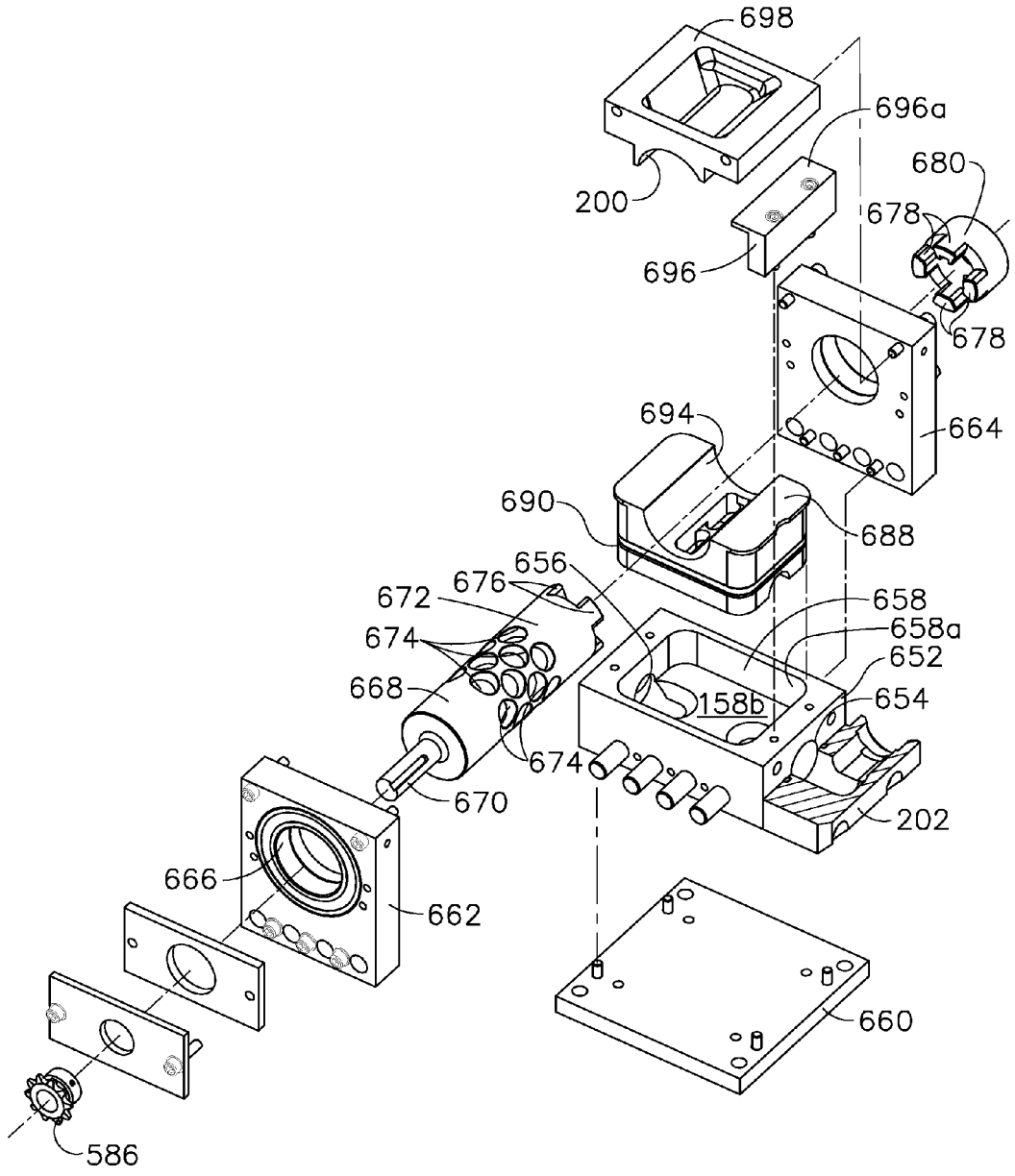
FIG. 33 is an exploded perspective view of the feeder assembly of the particle blast apparatus of FIG. 16.
Figure 34:
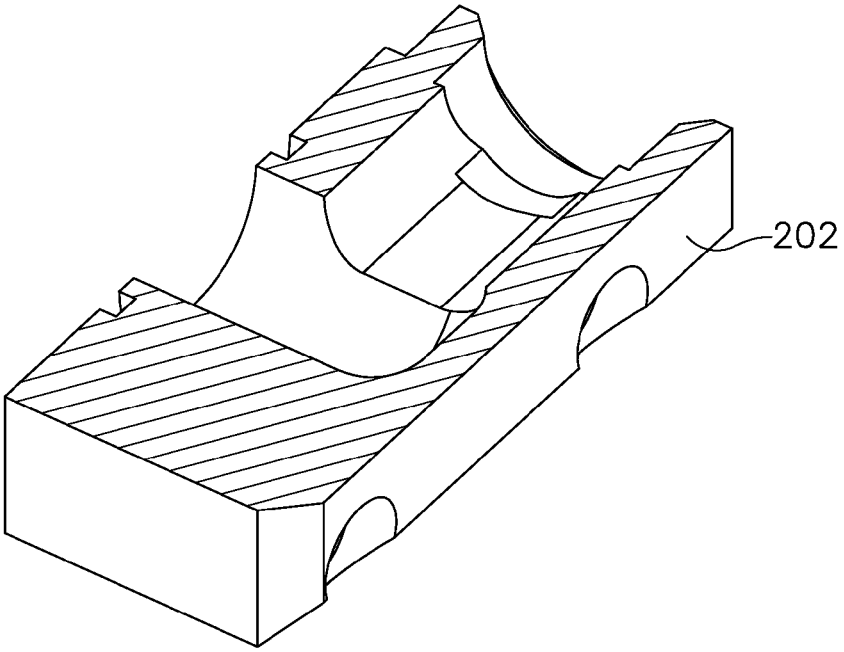
FIG. 34 is a cross-sectional perspective of the inlet fitting which attaches to the feeder block shown in FIG. 33.
Figure 35:
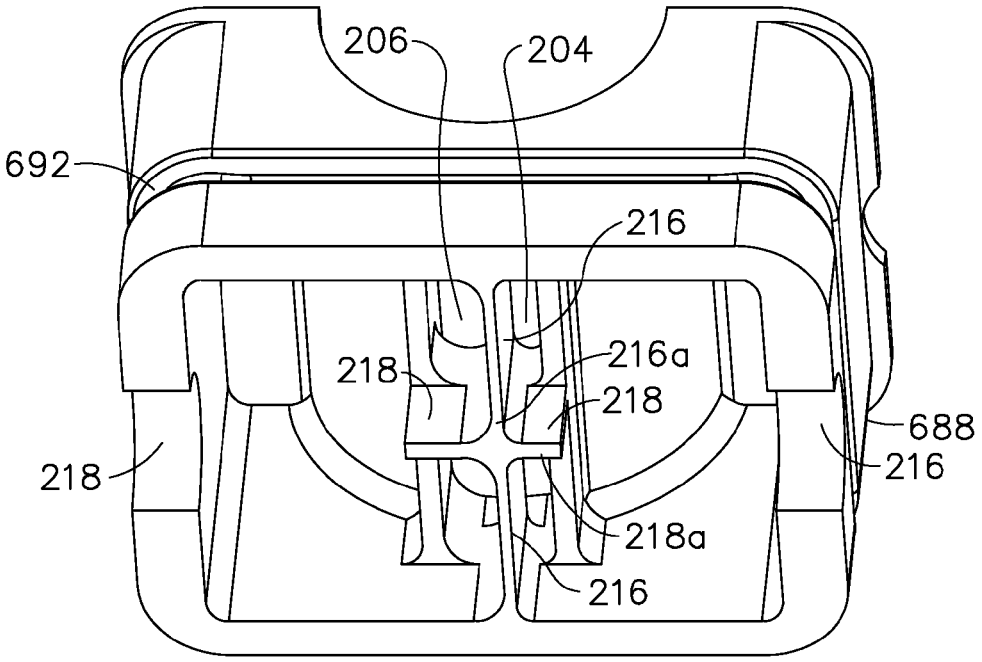
FIG. 35 is a bottom perspective view of the lower seal of the feeder assembly of FIG. 33.
Figure 36:
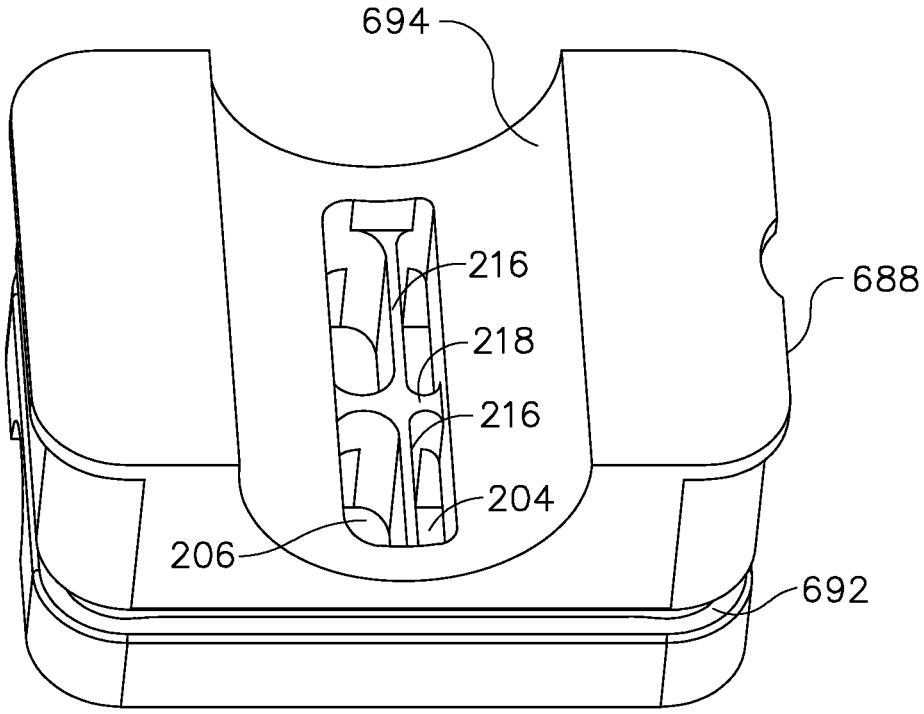
FIG. 36 is a top view of the lower seal of the feeder assembly of FIG. 33.
Figure 37:
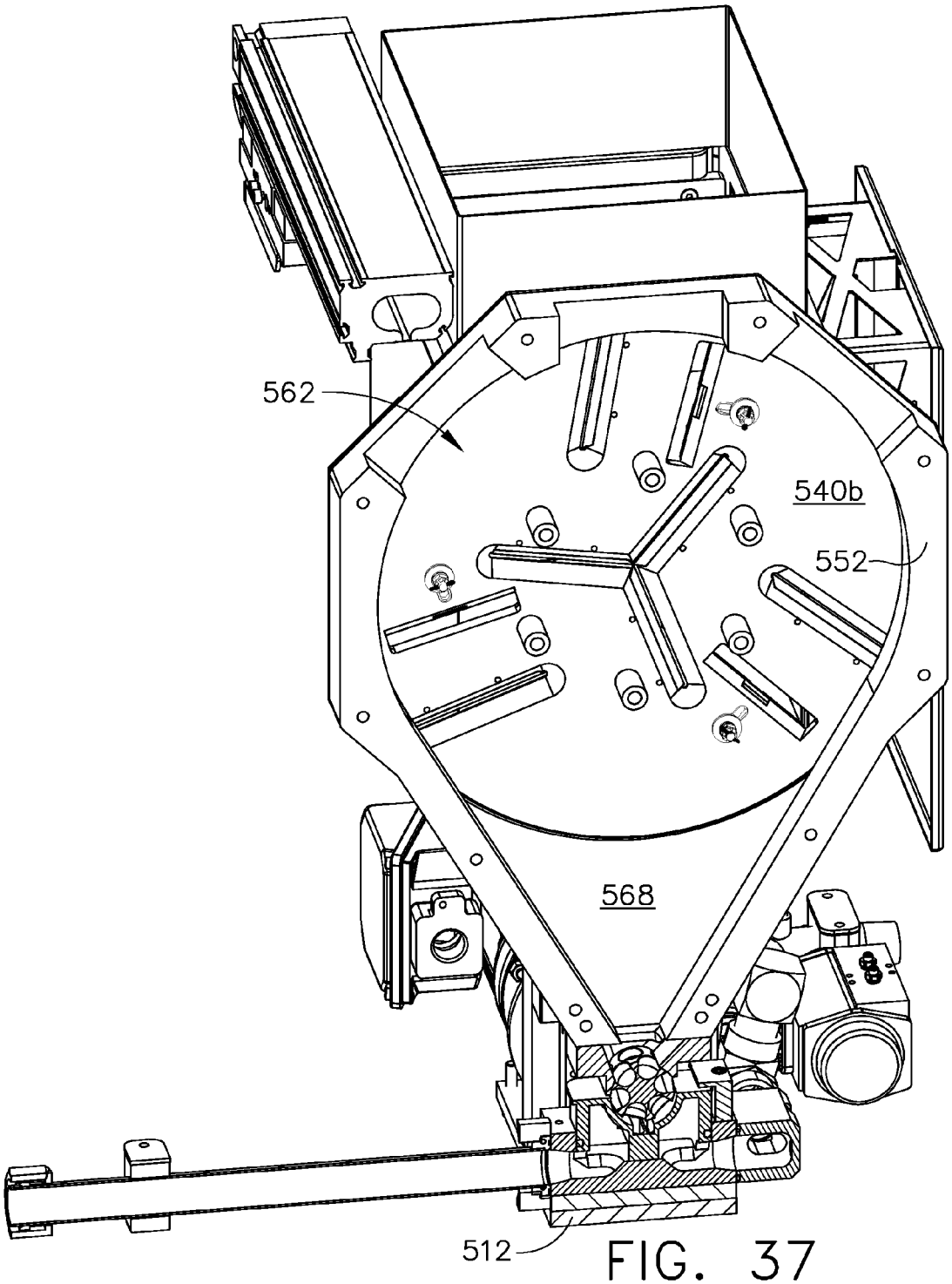
FIG. 37 is a perspective view of the particle generator and feeder assembly taken from the left with the feeder assembly shown in cross section.

Referring to FIGS. 24-28, rotatable carrier 540 includes a plurality of fixed openings 590 and adjustable openings 592. Also referring to FIG. 32, in the embodiment depicted, a plurality of fixed inserts 594 are disposed in respective recessed openings 596. The configuration of each recessed opening includes recessed portion 596*a* in surface 540*a* of rotatable carrier 540, recessed slot 596*b* diverging in the direction from surface 540*a* to 540*b* of rotatable carrier 540, and edge 596*c*. Each fixed insert 594 has working edge 598, with fixed openings 590 being the gaps defined between edges 596*c* of recessed openings 596 and working edges 598. Inserts 594 are secured to rotatable carrier 540 by a plurality of fasteners 600. Working edges 598 are configured to generate particles, such as granules, through a shaving action by moving across an adjacent face of a block of carbon dioxide being urged against inner surface 540*a* of rotatable carrier 540. In the embodiment depicted, working edges 598 are configured as knife edges extending above inner surface 540*a*. The size and amount of particles being generated by the shaving action is a function of the configuration of working edges 598 and fixed openings 590. The rate of the relative motion between working edges 598 and the adjacent face of the dry ice block determines the rate at which particles are generated for a particular working edge/fixed opening configuration.

In the embodiment depicted, an inner plurality of fixed openings 590 extending generally radially outward from the center of rotatable carrier 540. An outer plurality of fixed openings 590 is disposed spaced from the center of rotatable carrier 540 oriented non-radially. In the embodiment depicted, the outer plurality of fixed openings 590 appear oriented generally perpendicular to respective ones of the inner plurality of fixed openings 590. Any suitable configuration, e.g., location and orientation, of fixed openings 590 may be used. Additionally, although not shown in these figures, fixed inserts 594 could be configured to be movable to define non-fixed openings, with working edges 598 functioning to shave.

Figure 29:
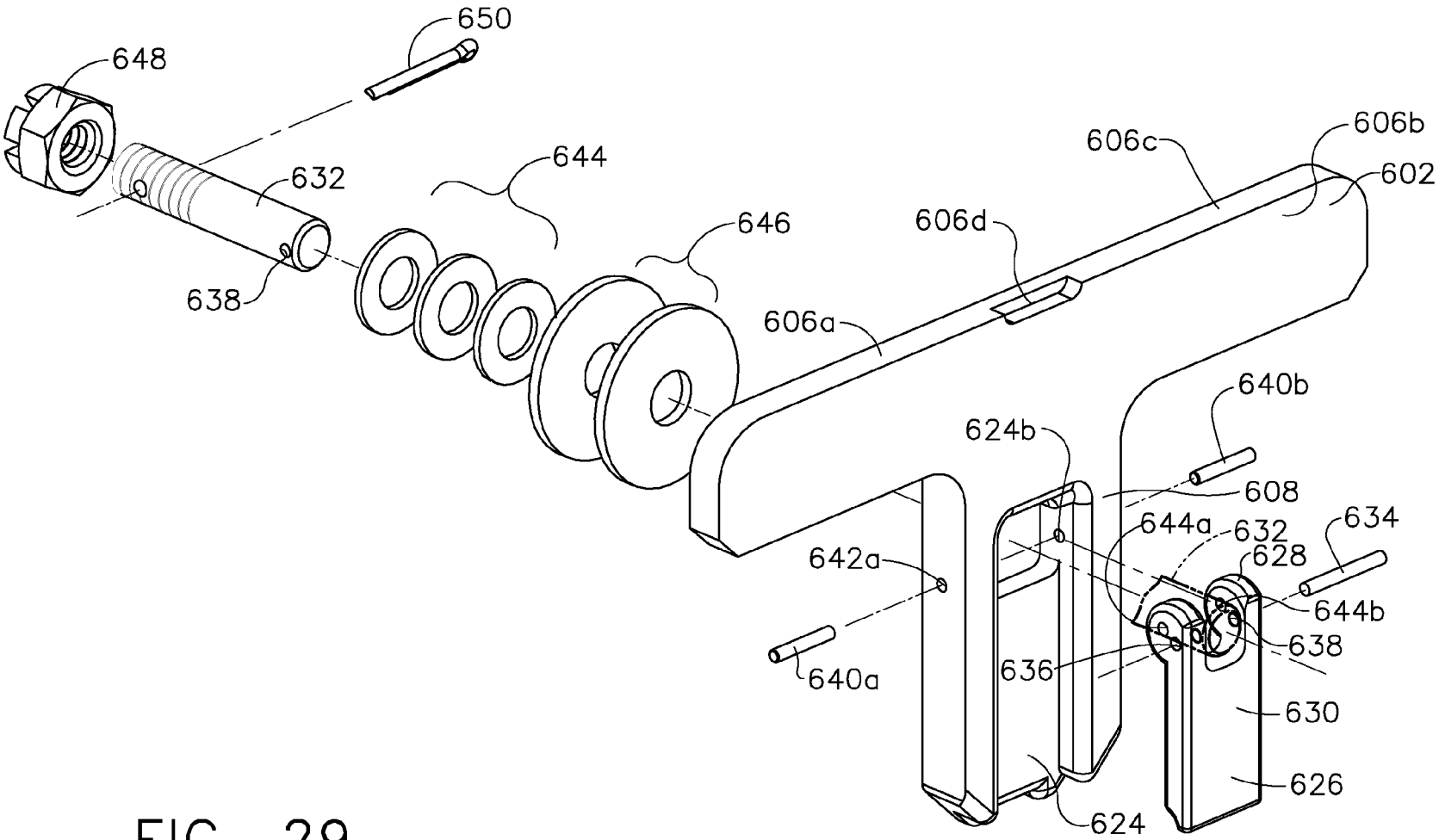
FIG. 29 is an exploded view illustrating a slide of the rotatable carrier.
Figure 30:
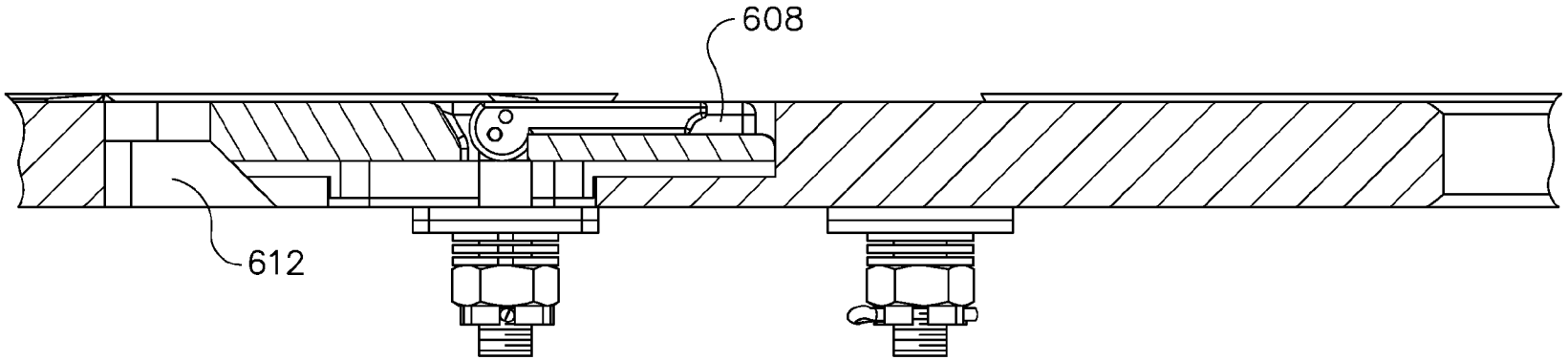
FIG. 30 is a cross-sectional view taken along line 30-30 of FIG. 25.
Figure 31:
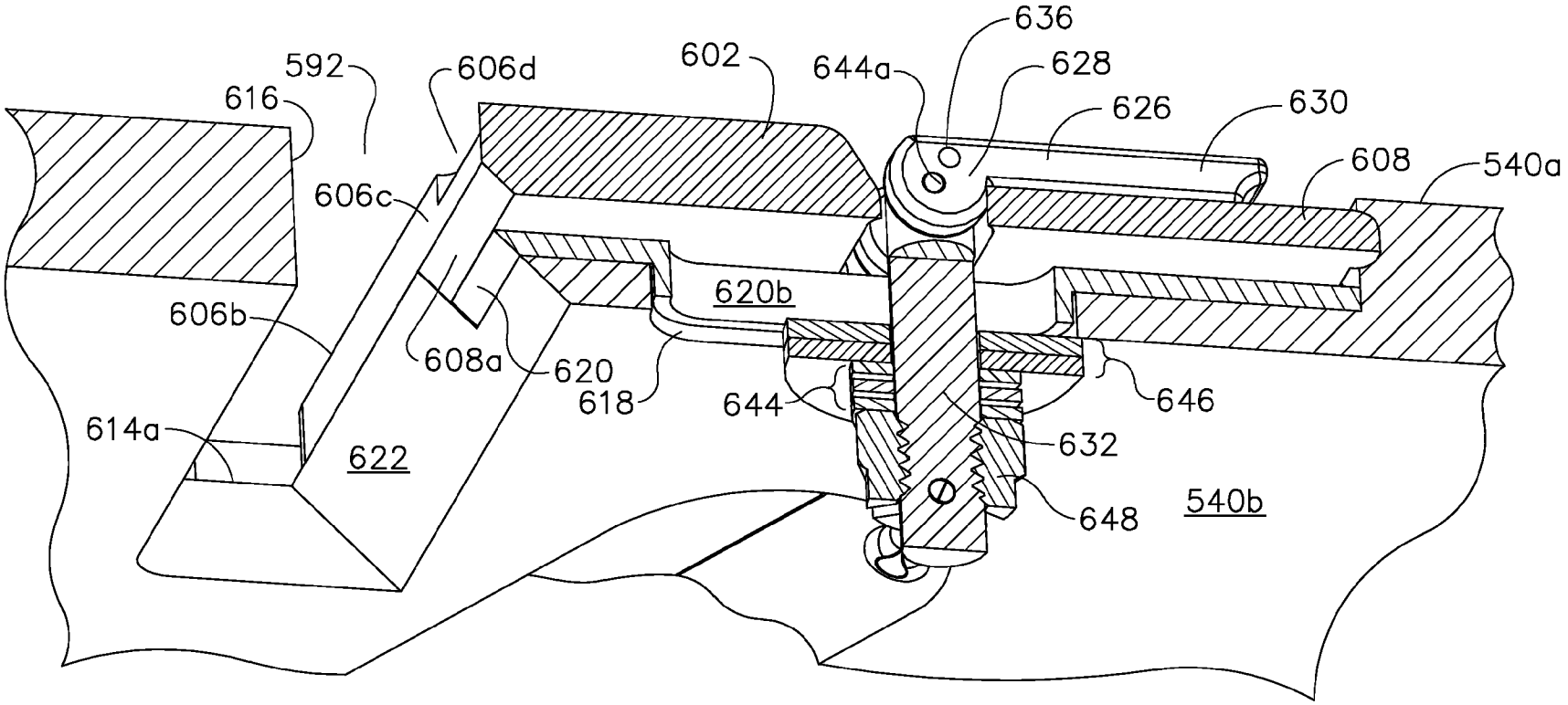
FIG. 31 is a cross-sectional perspective view similar to FIG. 30 illustrating the over center adjustment mechanism of the adjustable slide of the rotatable carrier.

Referring also to FIGS. 29-31, a plurality of movable inserts 602, also referred to herein as slides 602, are disposed in respective recessed openings 604. Each slide 602 has a generally T shaped configuration with arm portions 606*a* and 606*b* extending outwardly from central portion 608 generally perpendicularly therefrom. Recessed openings 604 include recessed central portion 610 and recessed arm portion 612 and 614. Recessed arm portion 612 includes tip 612*a* and recessed arm portion 614 includes recessed tip 614*a*.

Edges 616 define a fixed boundary of openings 592, with movable edges 606*c* of slides 602 defining the other boundary. Formed in edges 606*c* are recesses 606*d*, which provide a surface spaced apart from edges 616 when edges 606*c* are proximal edges 616.

Recessed arm portions 612 and 614 are depicted as having the same thickness of arm portions 606*a* and 606*b*, while the overall width is greater than the width of opening 592 with the distal ends of arm portions 606*a* and 606*b* overlying tips 612*a* and 614*a* respectively, providing support therefor.

Central portion 608 is thicker than arm portions 606*a* and 606*b*, as seen at 608*a*. Recessed central portion 610 of recessed opening 604 is shaped complementarily to central portion 608 although deeper than the thickness of central portion 608, and including elongated slot 618. Disposed within recessed central portion 610 is complementarily shaped stem portion insert 620, having elongated slot 620*a* defined by wall 620*b* which extends into elongated slot 618. Insert 620 may be made of any suitable material, such as UHMW.

Opening 604 includes inclined surface 622 extending divergingly in the direction toward outer surface 540*b*.

Central portion 608 includes recess 624 configured to receive rotatable over-center lever 626. Lever 626 includes head portion 628 and arm 630. Head portion 628 is pivotably connected to retaining member 632 by pin 634 extending through hole 636 in head portion 628 and hole 638 depicted as disposed generally on the axis of retaining member 632. Head portion is also pivotably connected to central portion 608 by two pins 640*a* and 640*b* extending through respective holes 642*a* and 642*b* of central portion 608 and into holes 644*a* and 644*b* of head portion 628.

Retaining member 632 is threaded at its end distal over center lever 626 and extends through slot 618 beyond outer surface 540*b* of rotatable carrier 540. A plurality of spring washers 644 disposed between bearing washers 646 and nut 648. To prevent nut 648 from rotating, cotter pin 650 is used. Over center lever is thus resiliently biased in the direction from inner surface 540*a* toward outer surface 540*b* by retaining member 632. Holes 644*a* and 644*b* are offset relative to holes 636 and 638, producing an over-center construction. Slide 602 may be moved within recessed opening between the fully open position illustrated in FIG. 31, whereat opening 592 is at its maximum size to the closed position with edge 616 adjacent edge 606*c*, whereat 592 is at its minimum, which is fully closed in the embodiment depicted.

In one mode, openings 592 may be set at their minimums when a block of solid carbon dioxide is disposed in supply bin 581 and working edges 598 are shaving particles from the adjacent face. In another mode, when loose particles, such as pellets, are disposed in supply bin 581, openings 592 may be set between and up to its minimum and maximum size to meter the loose particles to feeder assembly 512. The size of openings 592 as well as the rotational speed of rotatable carrier 540 determine the flow rate of particles. At any given rotational speed, the larger the openings 592 the higher the flow rate of particles.

Referring to FIGS. 33-38, feeder assembly 512 includes feeder block 652 in which inlet 654 and outlet 656 are formed. Inlet 654 includes inlet fitting 202. Feeder block 652 includes cavity 658 defined by wall 658*a* and bottom 658*b*. Feeder block 652 is secured to plate 660 which may be secured to the frame of apparatus 521. A pair of spaced apart supports 662 and 664 are secured to feeder block 652. Sealed bearing 666 is carried by support 662.

Rotor 668 may be from any suitable material and is depicted as a cylinder, although various other shapes, such as frustoconical may be used. Shaft 670 extends from rotor 668, with drive element 586 disposed thereon. Rotor 668 includes peripheral surface 672 in which a plurality of spaced apart pockets 674 are formed. In the embodiment shown, there are four circumferential rows of pockets 674, with each circumferential row having six pockets 674. Pockets 674 are also aligned in axial rows, with each axial row having two pockets 674. The axial and circumferential rows are arranged such that the axial and circumferential widths of pockets 674 overlap, but do not intersect, each other.

In this embodiment, rotor 668 includes legs 676 which are engaged by legs 678 of coupling 680. Coupling 680 may be secured to motor 682 such that rotor 668 may be driven by motor 682, thereby driving drive element 586, which in turn drives driven element 584 through endless drive element 588. In this configuration, when properly aligned, rotor 668 does not experience significant axial loading. Retaining plates 684 and 686 are disposed at one end of rotor 668, and may be made of any suitable material, such as UHMW plastic. The fit between bearing 666 and rotor 668 allows rotor 668 to be easily withdrawn from feeder assembly 512 by removing retaining plates 684 and 686, sliding rotor 668 out through bearing 666.

Lower seal pad 688 is disposed partially in cavity 658, with seal 690 located in groove 692, sealingly engaging groove 692 and wall 658*a*. Lower seal pad 688 includes surface 694 which, when assembled, contacts peripheral surface 672 of rotor 668, forming a seal therewith, as described below. Bracket 696 is attached to block 652 by fasteners (not shown), and has portion 696*a* which overlies the upper surface of lower seal 688 so as to retain lower seal 688 to block 652. As used herein, "pad" is not used as limiting: "Seal pad" refers to any component which forms a seal.

Upper seal pad 698 includes surface 200 which, when assembled, contacts peripheral surface 672 of rotor 668. Upper seal pad 698 and lower seal pad 688 may be made of any suitable material, such as a UHMW material. The ends of surfaces 694 and 200 may be chamfered to allow easier insertion of rotor 668.

Figure 38:
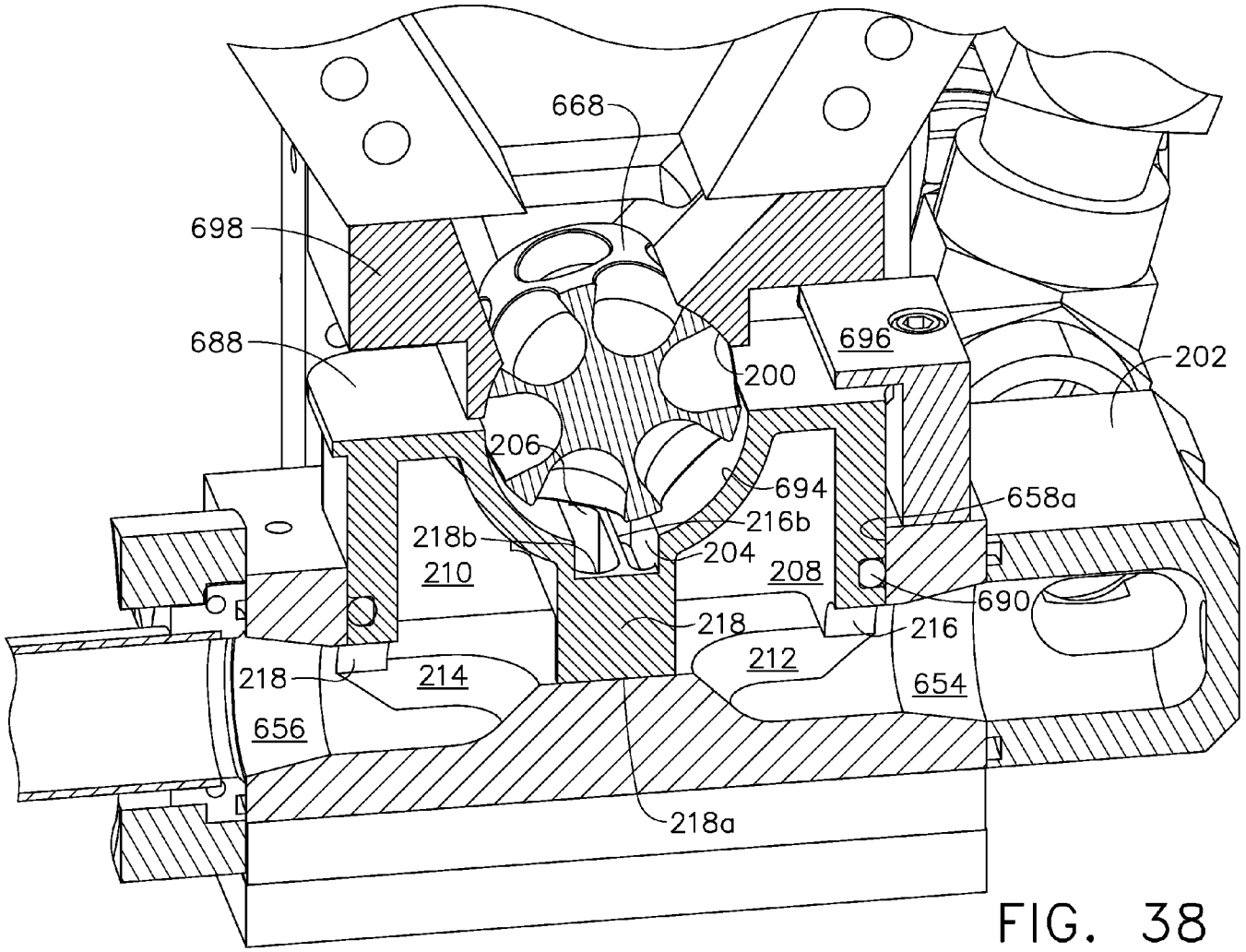
FIG. 38 is a cross-sectional perspective view of the feeder assembly of the particle blast apparatus of FIG. 16.

As seen in FIG. 38, lower pad seal 688 is disposed in cavity 658, with seal 690 engaging wall 658*a*, and upper pad seal 698 overlying but not engaging lower pad seal 688, surface 200 engaging rotor 668. Surface 694 includes two openings 204 which are in fluid communication with inlet 654 through upstream chamber 208, and two openings 206 which are in fluid communication with outlet 656 through downstream chamber 210. It is noted that although two openings 204 and two openings 206 are present in the illustrated embodiment, the number of openings 204 and openings 206 may vary, depending on the design of feeder assembly 512. For example, a single opening may be used for each. Additionally, more than two openings may be used for each.

Feeder assembly 512 has a transport gas flowpath from inlet 654 to outlet 656. In the depicted embodiment, passageways 212 and 214 are formed in feeder block 652. Lower seal pad 688 includes recess 216, which is aligned with inlet 654 and together with passageway 212, places upstream chamber 208 in fluid communication with inlet 654. Lower seal pad 688 also includes recess 218, which is aligned with outlet 656 and together with passageway 214, places downstream chamber 210 in fluid communication with outlet 656.

Upstream chamber 208 is separated from downstream chamber 210 by wall 216 which extends transversely across lower seal pad 688. Lower surface 216*a* of wall 216 seals against bottom 658*b* of cavity 658, keeping upstream chamber 208 separate from downstream chamber 210. Wall 218 is disposed perpendicular to wall 216, with lower surface 218*a* engaging bottom 658*b*.

As illustrated, in the depicted embodiment, inlet 654 is in fluid communication with outlet 656 substantially only through individual pockets 674 as they are cyclically disposed by rotation of rotor 668 between a first position at which an individual pocket first spans openings 204 and 206 and a second position at which the individual pocket last spans openings 204 and 206. This configuration directs substantially all of the transport gas entering inlet 654 to pass through pockets 674, which pushes the blast media out of pockets 674, to become entrained in the transport gas flow. Turbulent flow occurs in downstream chamber 210, promoting mixing of media with the transport gas. Such mixing of the media entrains the media in the transport gas, minimizing impacts between the media and the feeder components downstream of the pockets. The significant flow of the transport gas through each pocket 674 acts to effectively clean all media from each pocket 674.

It is noted that there is a gap above top 216*b* of wall 216 and top 218*b* of wall 218 and peripheral surface 672 of rotor 668. Some transport gas flows across tops 216*b* and 218*b* from upstream chamber 208 to downstream chamber 210.

Particles generated by action of the working edges across a block or a plurality of pellets disposed in supply bin 581, or particles passed through openings 592, travel directly through collector chamber 562 and internal passageway 568 into feeder assembly 512. The relative rates of rotatable carriage 540 and rotor 668 is set such that the displaced volumetric rate of pockets 574 is greater than the particle capacity of rotatable carrier 540 and associated parts at maximum speed. Thus, such particles reach feeder assembly 512 without being held or stored for any appreciable time period.

Alternative Slide Embodiment

Referring to FIGS. 39-43, a plurality of movable inserts 702, also referred to herein as slides 702, are disposed in respective recessed openings 704 which are similar to openings 604 described above. Edges 716 of recessed openings 704 define a fixed boundary of openings 592, with movable edges 706 of slides 702 defining the other boundary. Each slide 702 has a generally T shaped configuration that is similar to slide 602 described above.

Figure 39:
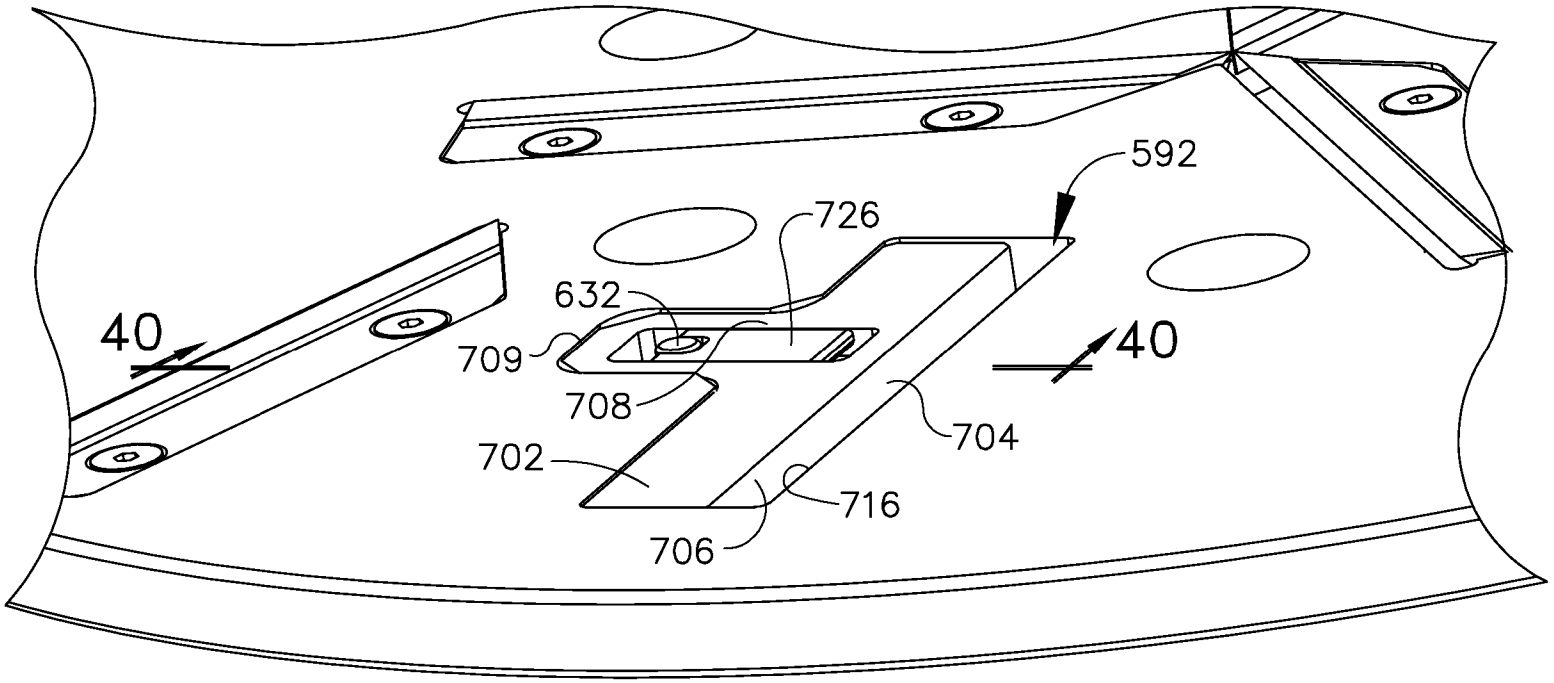
FIG. 39 is a fragmentary perspective view of an alternative movable insert received in an rotatable carrier disposed in an open position.
Figure 40:
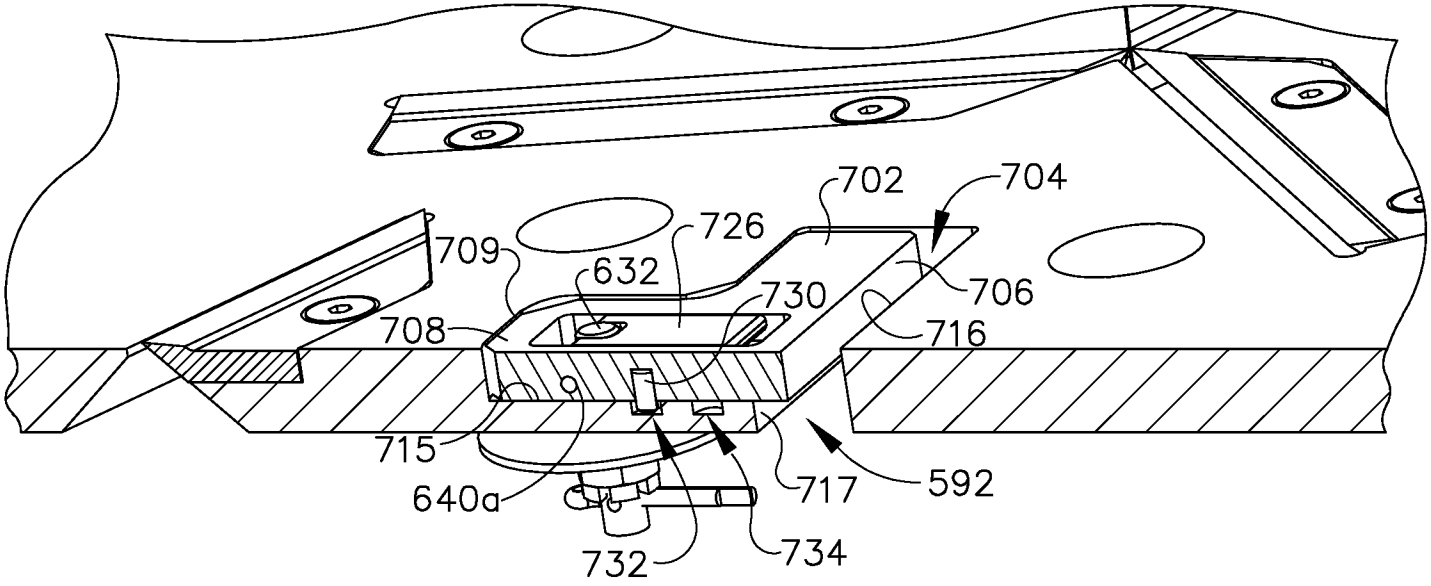
FIG. 40 is a fragmentary cross-sectional perspective view taken along line 40-40 of FIG. 39.
Figure 41:
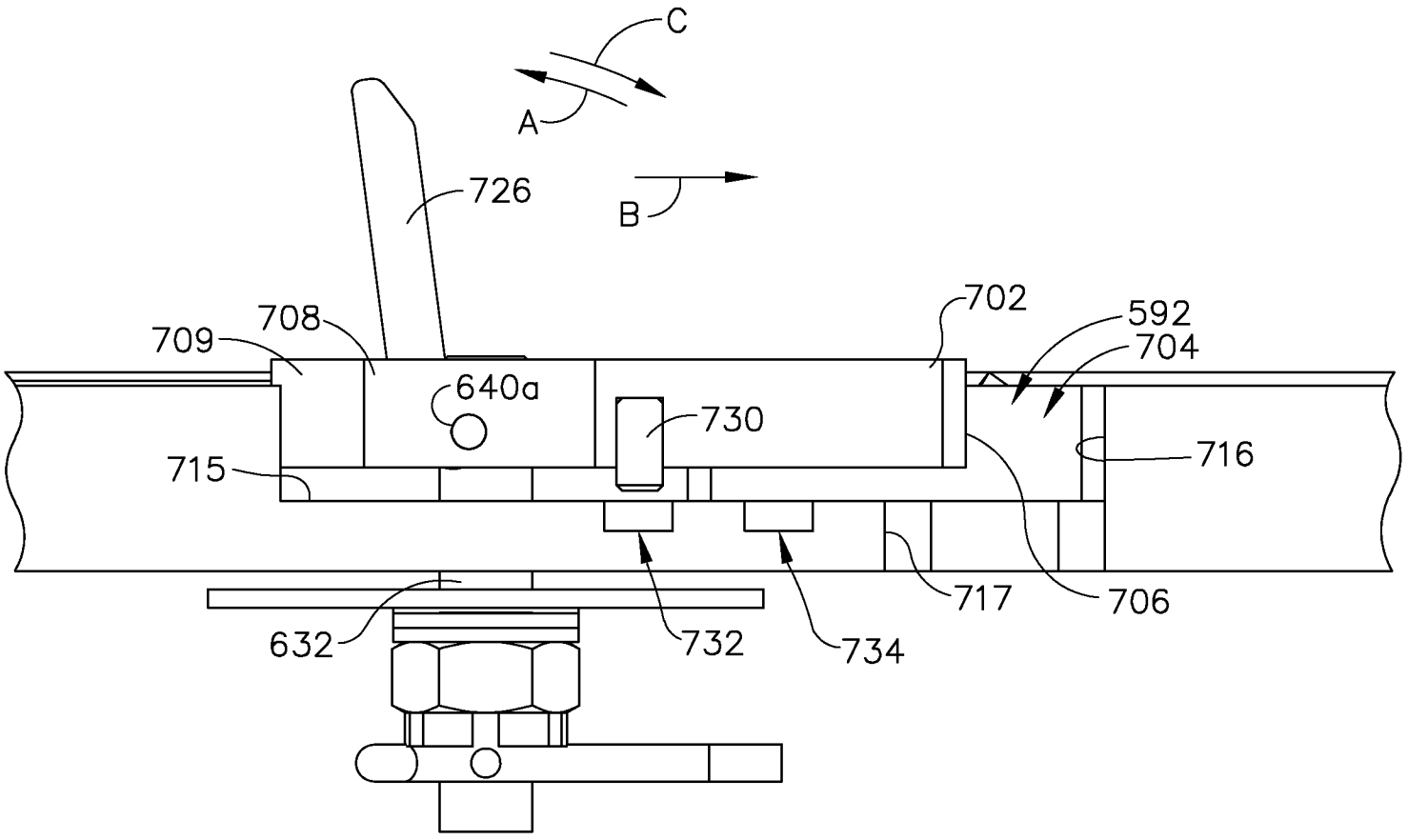
FIG. 41 is a fragmentary cross-sectional side view of the insert taken along line 40-40 of FIG. 39 with the lever of the insert in a rotated position that permits the adjustment of the insert between open and closed positions.
Figure 42:
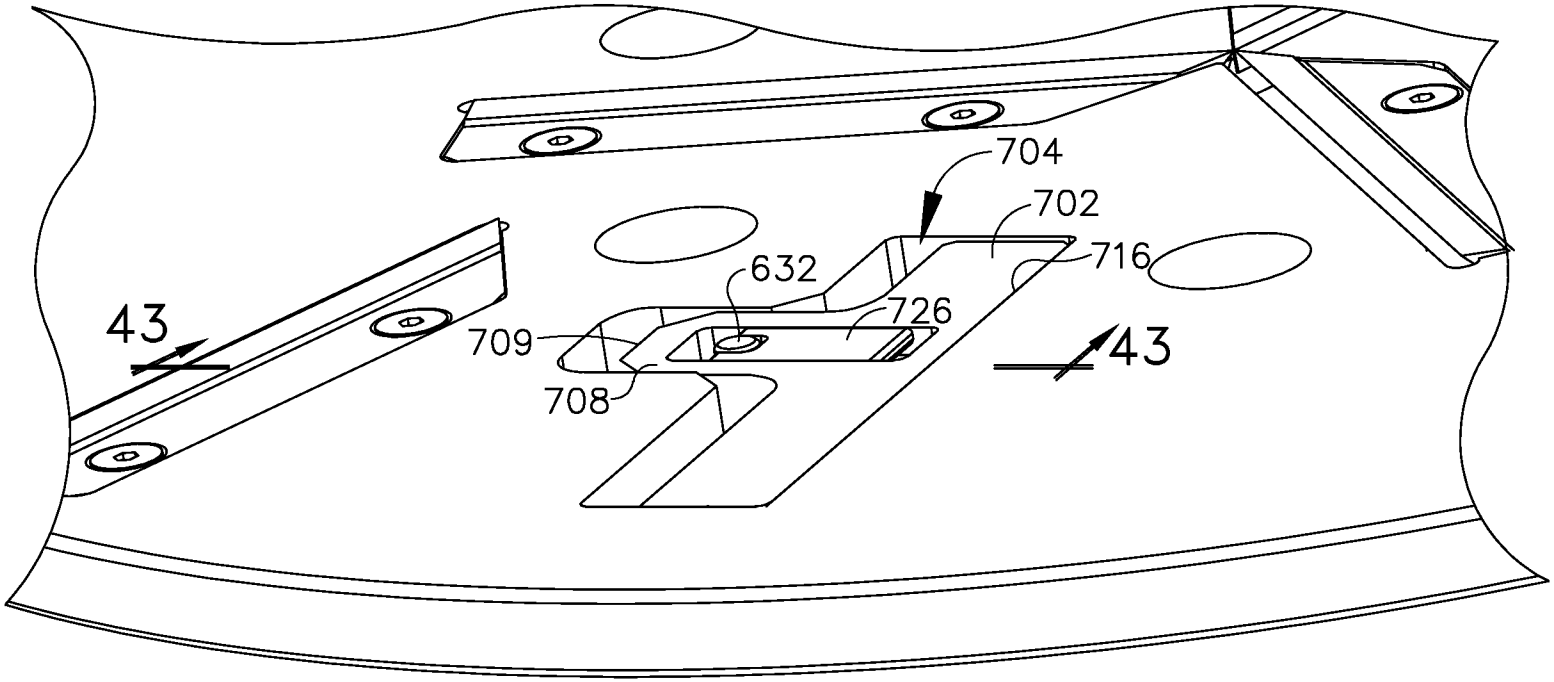
FIG. 42 is a fragmentary perspective view of the insert of FIG. 39 in a closed position.
Figure 43:
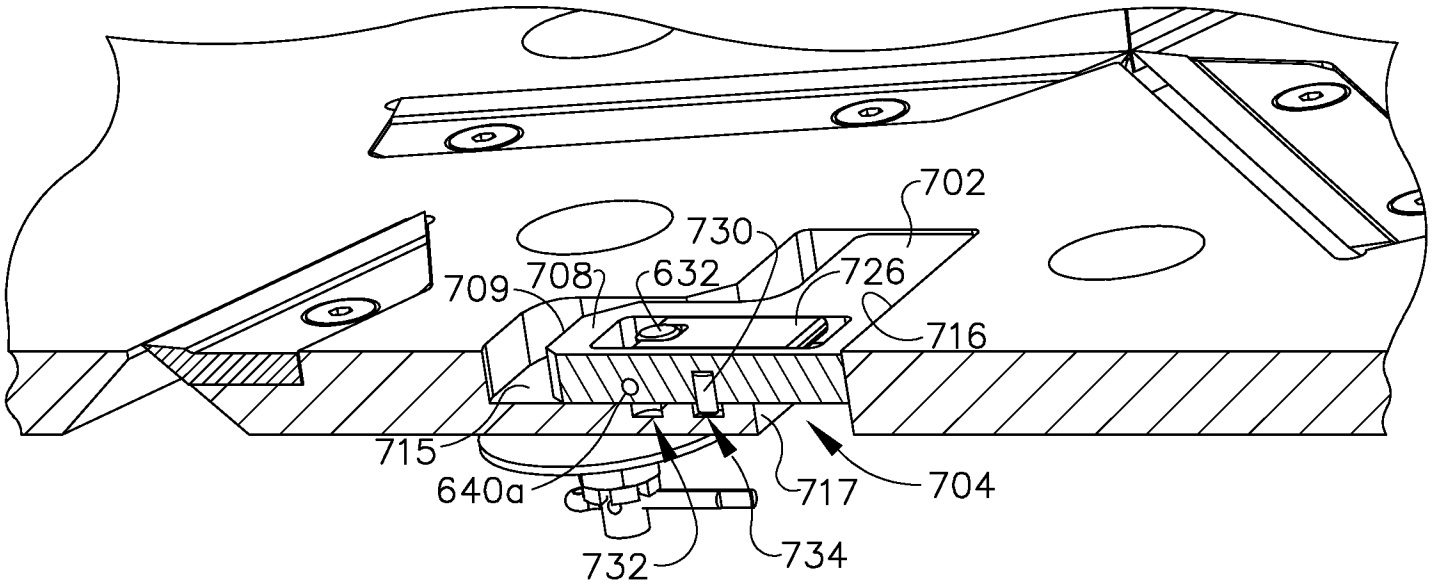
FIG. 43 is a cross-sectional view taken along line 43-43 of FIG. 42.

FIGS. 39-40 show insert 702 disposed in opening 704 in an open position, such that opening 592 is at a maximum size. As shown in FIG. 40, end 709 of central portion 708 is disposed above surface 715 defining recessed opening 704 and terminating at edge 717 that is spaced apart from edge 716. FIG. 41 shows lever 726 rotated in the direction of arrow (A) to a position from which it is possible to move insert 702 in the direction of arrow (B). As further described below, lever 726 is then rotated in the direction of arrow (C) to positively locate insert 702 with opening 604 in a closed position, as shown in FIGS. 42-43. In the closed position, opening 592 is closed and at its minimum size. Further, in the closed position, a portion of surface 715 is exposed as shown as surface 715*a* in FIG. 43.

As shown in FIGS. 40, 41, and 43, insert 702 includes pin 730 that projects from an undersurface of insert 702 and is configured to be received in one of two openings 732 or 734 in surface 715 of recessed opening 704. When insert 702 is in an open position as shown in FIG. 40, a sufficient portion of pin 730 is disposed within first opening 732 so as to provide positive locating of insert 702 within opening 704 sufficient to resist movement. To adjust insert 702, as shown in FIG. 41, lever 726 is rotated in the direction of arrow (A), allowing slide 702 to be moved away from surface 715 such that pin 730 is no longer disposed in first opening 732. Insert 702 may then be moved in the direction of arrow (B) to a location at which pin 730 aligns with second opening 734, and moved toward surface 715 causing pin 730 to be disposed within second opening 734. Lever 726 is rotated in the direction of arrow (C) to hold slide 702 adjacent or at least sufficiently proximal surface 715 such that at least a portion of pin 730 remains disposed in second opening 734 so as to positively locate insert 702 within opening 704 sufficient to resist movement of slide 702 from the closed position as shown in FIG. 43. Alternately, pin 730 and first and second openings 732, 734, may be replaced by a resilient detent configuration, such as with a spring and ball detent carried by slide 702 engaging shallow openings in surface 715 in place of first and second openings 732, 734, sufficiently strong to retain slide 702 in the desired location. Although only open and closed positions are illustrated, it is within the scope of the present disclosure to provide one or more additional positive locating positions for slide 702 intermediate the full open and full closed positions.

The foregoing description of one or more embodiments of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. Although only a limited number of embodiments of the invention is explained in detail, it is to be understood that the invention is not limited in its scope to the details of construction and arrangement of components set forth in the preceding description or illustrated in the drawings. The invention is capable of other embodiments and of being practiced or carried out in various ways. Also, in describing the preferred embodiment, specific terminology was used for the sake of clarity. It is to be understood that each specific term includes all technical equivalents which operate in a similar manner to accomplish a similar purpose. It is intended that the scope of the invention be defined by the claims submitted herewith.

Another embodiment of the present invention is described in U.S. Provisional Patent Application Ser. No. 61/594,347, filed on Feb. 2, 2012, titled APPARATUS AND METHOD FOR HIGH FLOW PARTICLE BLASTING WITHOUT PARTICLE STORAGE, which is incorporated herein by reference and which is set forth Appendix A of this application.

The foregoing description has been presented for purposes of illustration and description. It is not intended to be exhaustive or to limit the invention to the precise form disclosed. Obvious modifications or variations are possible in light of the above teachings. The embodiment was chosen and described in order to illustrate the principles of the invention and its application to thereby enable one of ordinary skill in the art to utilize the invention in various embodiments and with various modifications as are suited to the particular use contemplated. Although only a limited number of embodiments of the invention is explained in detail, it is to be understood that the invention is not limited in its scope to the details of construction and arrangement of components set forth in the preceding description or illustrated in the drawings. The invention is capable of other embodiments and of being practiced or carried out in various ways. Also, specific terminology was used herein for the sake of clarity. It is to be understood that each specific term includes all technical equivalents which operate in a similar manner to accomplish a similar purpose. It is intended that the scope of the invention be defined by the claims submitted herewith.

We claim:

1. A method of utilizing a rotatable carrier to generate particles of solid carbon dioxide for introduction into a transport gas flow system, said method comprising the steps of:

a. providing a particle generator comprising a first side, a second side, and a plurality of first and second openings, each of said first openings having a respective size which is selectively settable at one of a first size and a second size;

b. selectively setting the respective size of at least one of the plurality of first openings at the first size if particles are to be generated from discrete particles and at the second size if particles are to be generated from a block;

c. urging one of a block or discrete particles of solid carbon dioxide against the first side of the particle generator;

d. rotating the particle generator; and e. generating particles from the second side of the particle generator.

2. The method of claim 1, wherein the step of selectively setting the respective size of at least one of the plurality of first openings comprises the step of positioning a respective insert at a respective first location so as to set the respective size at the first size.

3. The method of clam 2, wherein the step of positioning a respective insert at a respective first location comprises the step of positively locating the respective insert at the respective first location.

4. The method of claim 3, wherein the step of positively locating the respective insert comprises the step of engaging the respective insert with a pin.

5. The method of claim 1, wherein the step of selectively setting the respective size of at least one of the plurality of first openings comprises the step of positioning a respective insert at a respective second location at which the respective insert closes the at least one of the plurality of first openings.

6. The method of claim 5, wherein the step of positioning a respective insert at a respective second location comprises the step of positively locating the respective insert at the respective second location.

7. The method of claim 6, wherein the step of positively locating the respective insert comprises the step of engaging the respective insert with a pin.

* * * * *